US006562098B1

(12) United States Patent
Fujitsuka et al.

(10) Patent No.: US 6,562,098 B1
(45) Date of Patent: May 13, 2003

(54) WEAR RESISTANT SINTERED MEMBER

(75) Inventors: Hiroki Fujitsuka, Ichikawa (JP); Hideaki Kawata, Matsudo (JP); Koichiro Hayashi, Matsudo (JP); Tomonori Miyazawa, Yokohama (JP); Koji Koyanagi, Yokohama (JP); Akira Fujiki, Yokohama (JP); Hideki Muramatsu, Yokohama (JP); Kunio Maki, Yokohama (JP); Yoshio Okada, Yokohama (JP); Shin Nomura, Yokohama (JP)

(73) Assignees: Hitachi Powdered Metals Co., Ltd., Matsudo (JP); Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/211,343

(22) Filed: Aug. 5, 2002

(30) Foreign Application Priority Data

Aug. 6, 2001 (JP) ..... 2001-237589
Jun. 7, 2002 (JP) ..... 2002-166585

(51) Int. Cl.[7] ..... C22C 33/02
(52) U.S. Cl. ..... 75/243; 75/246
(58) Field of Search ..... 75/246, 243

(56) References Cited

U.S. PATENT DOCUMENTS 4,919,719 A * 4/1990 Abe et al. ..... 75/243
5,834,664 A * 11/1998 Aonuma et al. ..... 75/246
5,952,590 A * 9/1999 Kawata et al. ..... 75/231
6,251,157 B1 * 6/2001 Aoki et al. ..... 75/231

FOREIGN PATENT DOCUMENTS

JP B2 55-36242 9/1980
JP B2 5-55593 8/1993
JP A 7-233454 9/1995

* cited by examiner

*Primary Examiner*—Ngoclan Mai
(74) *Attorney, Agent, or Firm*—Oliff & Berridge, PLC

(57) ABSTRACT

A wear resistant sintered member exhibits superior wear resistance at the same level as those of the conventional materials without using a Co-based hard phase is provided. A first hard phase comprising Mo silicide particles dispersed in an Fe-based alloy matrix of the first hard phase and a second hard phase comprising a ferrite phase or a mixed phase of ferrite and austenite having a higher Cr concentration than the Fe-based alloy matrix surrounding a core consisting of Cr carbide particles, are diffused in an Fe-based alloy matrix, the Mo silicide particles are contained in the first hard phase in an amount of 3 to 25 % by area, and the Cr carbide particles are contained in the second hard phase in an amount of 3 to 30 % by area.

19 Claims, 19 Drawing Sheets

WEAR RESISTANT SINTERED MEMBER

BACKGROUND OF THE INVENTION

1. Field of the Invention

The present invention relates to a wear resistant sintered member which is superior in wear resistance at high temperatures, and in particular, relates to a technique suited to be used for a valve seat insert of internal combustion engines.

2. Description of the Related Art

In order to deal with performance enhancement and power increase of engines for automobiles, a sintered alloy for a valve seat insert having high wear resistance and high strength at high temperature has been required, and the present applicants have also developed a wear resistant sintered alloy (Japanese Patent Publication No. 55-36242) manufactured by a method disclosed in Japanese Patent No. 1043124. In addition, the applicants further developed wear resistant sintered alloys which are superior in high wear resistance and high strength at high temperature, as disclosed in Japanese Patent Publication No. 5-55593, Japanese Patent Application Laid-open No. 7-233454, and the like, in order to deal with recent even greater performance enhancement, power increase, and in particular, increase in combustion temperature due to lean combustion. However, the above conventional materials were disadvantageous in cost because expensive Co-based materials were employed as a hard phase in order to improve the performance at high temperature.

SUMMARY OF THE INVENTION

It is an object of the present invention to provide a wear resistant sintered member which can exhibit superior wear resistance at the same level as those of the conventional materials without using a hard phase consisting of Co-based materials.

First Embodiment of Wear Resistant Sintered Member of the Present Invention

In order to solve the above problems, a first embodiment of a wear resistant sintered member according to the present invention exhibits a metallographic structure comprising a first hard phase and a second hard phase diffused in an Fe-based alloy matrix, wherein the first hard phase comprises Mo silicide particles dispersed in an Fe-based alloy matrix of the first hard phase, the second hard phase comprises a ferrite phase or a mixed phase of ferrite and austenite having a higher Cr concentration than the Fe-based alloy matrix surrounding a core consisting of Cr carbide particles, the Mo silicide particles in the first hard phase are contained in an amount of 3 to 25% by area in the member, and the Cr carbide particles in the second hard phase are contained in an amount of 3 to 30% by area in the member. FIG. 1 shows a schematic drawing of the metallographic structure.

① First Hard Phase

As shown in FIG. 1, in the first hard phase, Mo silicide is dispersed in an Fe-based alloy matrix of the first hard phase, and moreover, composite silicide composed of Mo, Fe, Cr, or Ni, or intermetallic compounds of these elements, may be partially dispersed instead of the Mo silicide. Mo silicide is hard so as to have an effect which improves wear resistance of the wear resistant sintered member, and it has solid lubricity so that action (facing member interaction) which wears or attacks a facing material is low.

In addition, it is preferable that the alloy matrix of the first hard phase for dispersing Mo silicide, etc., be composed of an alloy consisting of Fe and at least one of Ni and Cr. Wear resistance of the first hard phase can be further improved by strengthening the alloy matrix of the first hard phase. Furthermore, Ni or Cr in the alloy matrix of the first hard phase has an effect in which adhesion to the alloy matrix is further strengthened by diffusing into the surrounding matrix.

The Mo silicide particles must be dispersed in the matrix of the first hard phase of the wear resistant sintered member in an amount of 3 to 25% by area. Here, the "area" of the Mo silicide particles refers as an inside area of an outline of the Mo silicide particles. When it is under 3% by area, an improvement effect is poor, and in contrast, when it exceeds 25% by area, facing member interaction increases, and the facing member is thereby worn.

② Second Hard Phase

As shown in FIG. 1, the second hard phase is a phase in which a ferrite phase or a mixed phase of ferrite and austenite, having a higher Cr concentration than the matrix, surrounds a core consisting of Cr carbide particles. Since Cr carbide as a core receives impacts in a valve seating and the surrounding mixed phase of austenite and ferrite has a buffering effect, wear resistance is improved. In addition, Cr which further diffuses contributes to improvement of wear resistance of the overall sintered alloy by acting to strengthen the matrix or the second hard phase as described below. Furthermore, when carbide particles of Mo, V, or W, are dispersed in addition to Cr carbide particles in the second hard phase, it is effective to further improve wear resistance.

The Cr carbide particles must be dispersed in the matrix of the second hard phase in an amount of 3 to 30% by area. Here, an area of the Cr carbide particles refers as an inside area of an outline of the Cr carbide particles. When it is under 3% by area, the above effect is poor and does not contribute to wear resistance, and in contrast, when it exceeds 30% by area, wear of a facing material is enhanced by hard Cr carbide, etc., and worn powder of a facing material acts as grinding particles, so that the sintered member also is worn.

Component composition and metallographic structure of the matrix in a wear resistant sintered member of the present invention are not limited, and conventional alloys can be employed.

Second Embodiment of Wear Resistant Sintered Member of the Present Invention In order to solve the above problem, a second embodiment of a wear resistant sintered member according to the present invention has an overall composition comprising, by mass, Mo: 1.25 to 17.93%, Si: 0.025 to 3.0%, C: 0.35 to 0.95%, at least one of Cr: 0.025 to 3.0% and Ni: 0.025 to 3.0%, and a balance of Fe and unavoidable impurities, and exhibits a metallographic structure comprising a matrix which consists of bainite or a mixture of bainite and martensite, and a first hard phase comprising Mo silicide particles dispersed in an alloy matrix which consists of Fe and at least one of Ni and Cr, wherein the Mo silicide particles are contained in the alloy matrix of the first hard phase in an amount of 3 to 30% by area.

FIG. 2 shows a schematic drawing of a metallographic structure of the second embodiment of a wear resistant sintered member according to the present invention. As shown in FIG. 2, in the second embodiment of a wear resistant sintered member of the present invention, the above first hard phase is strengthened by Ni and/or Cr, the composition of the matrix comprises, by mass, Mo: 0.8 to 4.2%, C: 0.35 to 0.95%, and a balance of Fe and unavoidable impurities, and the matrix consists of bainite or a mixture of bainite and martensite, and therefore, strength and wear resistance of the matrix are improved and superior wear resistance is exhibited by only the first hard phase.

In the first hard phase, Mo silicide is dispersed in an alloy matrix consisting of Fe and at least one of Ni and Cr. When the Mo silicide particles are dispersed in the alloy matrix of the first hard phase in an amount of less than 3% by area, the improvement effect of the wear resistance is insufficient. In contrast, the upper limit of the content of the Mo silicide particles in the first hard phase is higher than that of the above embodiment of a wear resistant sintered member since the second embodiment has no second hard phase; however, when it exceeds 30% by area, the facing member interaction increases and a facing member is thereby worn.

The matrix has a single phase structure consisting of bainite which has high strength, which is hardest after martensite, and which is superior in wear resistance, or has a mixed structure of the above bainite and martensite which is the hardest structure and which has a high facing member interaction. In the mixed structure, by mixing martensite and bainite, the facing member interaction of martensite is eased and the hardness is moderately reduced, and therefore, the wear resistance is improved. In the matrix in the present invention, since Mo is contained, fine Mo carbide particles precipitate and, the wear resistance is further improved.

Third Embodiment of Wear Resistant Sintered Member of the Present Invention

A third embodiment of a wear resistant sintered member according to the present invention has an overall composition comprising, by mass, Mo: 1.01 to 15.43%, Si: 0.025 to 2.5%, C: 0.36 to 1.67%, Cr: 0.2 to 7.5%, and a balance of Fe and unavoidable impurities, and exhibiting a metallographic structure comprising an alloy matrix which consists of bainite or a mixture of bainite and martensite, a first hard phase and a second hard phase diffused in the above Fe-based alloy matrix, wherein the first hard phase comprises Mo silicide particles dispersed in an Fe-based alloy matrix of the first hard phase, the second hard phase comprises a ferrite phase or a mixed phase of ferrite and austenite, having a higher Cr concentration than the alloy matrix, surrounding a core consisting of Cr carbide particles, the Mo silicide particles are contained in the first hard phase in an amount of 3 to 25% by area, and the Cr carbide particles are contained in the second hard phase in an amount of 3 to 30% by area.

FIG. 3 shows a schematic drawing of a metallographic structure of the third embodiment of a wear resistant sintered member according to the present invention. As shown in FIG. 3, in the third embodiment of a wear resistant sintered member of the present invention, a second hard phase in a wear resistant sintered member of the above first embodiment is diffused in a wear resistant sintered member of the above second embodiment, and the upper limit of the content of the first hard phase is limited in an amount of 25% by area, in order to diffuse the second hard phase.

In a wear resistant sintered member in the third embodiment, it is preferable that at least one of Ni: 0.025 to 2.5% by mass and Cr: 0.025 to 2.5% by mass be added as an overall composition to the above first hard phase, and that the alloy matrix consist of Fe and at least one of Ni and Cr. The wear resistance of the first hard phase can be further improved by strengthening the alloy matrix in the first hard phase. Furthermore, Ni or Cr in the alloy matrix to of the first hard phase has an effect in which adhesion to the alloy matrix is further strengthened by diffusing into the surrounding matrix.

The second hard phase is a phase in which a ferrite phase or a mixed phase of ferrite and austenite, having a higher Cr concentration than the matrix, surrounds a core consisting of Cr carbide particles. The Cr carbide in the second hard phase is hard and contributes to improvement of wear resistance. The ferrite phase or the mixed phase of ferrite and austenite having a higher Cr concentration than the surrounding soft matrix adheres Cr carbide firmly and for example, when the sintered member is used as a valve seat insert, it acts as a buffer material in the seating of a valve which is a facing material, and has an effect which absorbs impacts on the facing material.

When the content of the Cr carbide particles in the second hard phase is under 5% by area, the effect of improvement of wear resistance is very poor, and in contrast, when it exceeds 30% by area, the facing member interaction increases and the facing material is thereby worn. Furthermore, in the case in which the Mo silicide particles in the first hard phase coexist with the second hard phase, when it is contained exceeding 25% by area, facing member interaction of the overall member increases and therefore, the upper limit thereof is set to be 25% by area. In the wear resistant sintered member of the third embodiment, the content of the Mo silicide particles is set to be 5% by area or more in order to exhibit the effect of the first hard phase.

It is preferable that hardness of the Mo silicide particles of the first hard phase in the above wear resistant sintered members of the first to third embodiments described above be MHV ranging from 600 to 1400. When the hardness of the Mo silicide is low, the effect of improvement of the wear resistance is insufficient, and in contrast, when it is excessively high, the facing member interaction increases and the wear of the facing member is promoted. Therefore, it is preferable that the hardness of the first hard phase consisting of the Mo silicide be MHV of 600 to 1400.

Each Component Elements of Second and Third Embodiments of Wear Resistant Sintered Member of the Present Invention Mo: Mo contributes to the formation of the first hard phase which is superior in wear resistance by forming Mo silicide as described above. Furthermore, the matrix is solid-solution-strengthened by dissolving Mo therein in addition to the formation of the above silicide and the matrix structure thereby consists of a bainite phase or a mixed phase of bainite and martensite and Mo also contributes to improving the wear resistance of the matrix. When the content of Mo is low, the strengthening effect of the matrix or precipitation amount of Mo silicide is reduced, and an improvement effect on wear resistance is decreased. In contrast, when Mo is contained in excess, the precipitation amount of Mo silicide is too much or the matrix becomes too hard, facing member interaction increases, and wear of a facing material thereby increases. Therefore, in the case of the second embodiment of a wear resistant sintered member of the present invention, the Mo content of 1.25 to 17.93% by mass is preferred, and in the case of the third embodiment thereof, the Mo content of 1.0 to 15.43% by mass is preferred.

Si: Si contributes to improving wear resistance by reacting with Mo to form hard Mo silicide of the first hard phase. When the content of Si is low, silicide is not sufficiently precipitated. In contrast, when Si is contained in excess, the compressibility is reduced due to powder hardening, and the adhesion to the matrix is reduced by firmly forming an oxide film on the surface of the powder. Therefore, in the case of the second embodiment of a wear resistant sintered member of the present invention, the Si content of 0.025 to 3.0% by mass is preferred, and in the case of the third embodiment thereof, the Si content of 0.025 to 2.5% by mass is preferred.

Cr: Cr is selectively added to the first hard phase with Ni as described below, and in the third embodiment of a wear resistant sintered member, it is also added to the second hard phase.

Cr in the first hard phase has an effect in which the hardness of the first hard phase is increased by strengthening the alloy matrix of the first hard phase, and thereby the wear resistance is improved and the falling off of the Mo silicide is prevented. In addition, it also has an effect in which the adhesion to the matrix is improved by dispersing in the matrix structure. Therefore, by these effects, it contributes to the improvement of the wear resistance. When the content of Cr contained as a first hard phase is low, the above effects which act in the hard phase are insufficient. In contrast, when Cr is contained in excess therein, the compressibility is reduced due to powder hardening, and the adhesion to the matrix is reduced by firmly forming an oxide film on the surface of the powder. Therefore, in the case of the second embodiment of a wear resistant sintered member of the present invention, it is preferable that the content of Cr contained as a first hard phase be 0.025 to 3.0% by mass in overall composition, and in the case of the third embodiment thereof, it is preferable that it be 0.025 to 2.5% by mass in overall composition.

Cr in the second hard phase forms a second hard phase in which a hard phase consisting of Cr carbide is a core, and thereby the wear resistance is further improved. In addition, Cr which diffused from the second hard phase to the matrix strengthens the adhesion between the hard phase and the matrix, and further strengthens the matrix structure or matrix of the first hard phase, and the hardenability is thereby further improved. Furthermore, it is effective that an area having a high Cr concentration surrounding the second hard phase form ferrite and has an effect which buffers an impact in a valve seating and which prevents hard components such as Cr carbide, etc., from falling off on a wear sliding surface. When the content of Cr contained as a second hard phase is low, the above effects which act in the hard phase are insufficient. In contrast, when Cr is excessively contained therein, the compressibility is reduced due to powder hardening, and the adhesion to the matrix is reduced by firmly forming an oxide film on the surface of the powder. Therefore, it is preferable that the content of Cr contained as a second hard phase be 0.2 to 7.5% by mass in overall composition.

Therefore, in the case in which it is selected as a first hard phase forming element in the second embodiment of a wear resistant sintered member of the present invention, it is preferable that the content of Cr be 0.025 to 3.0% by mass, and in the third embodiment thereof, in the case in which it is not selected as a first hard phase forming element, it is preferable that it be 0.2 to 7.5% by mass, or in the case in which it is selected as a first hard phase forming element, it is preferable that it be 0.225 to 10% by mass.

Ni: Ni is selectively added to the first hard phase with Cr as described above, and has an effect in which the hardness of the first hard phase is increased by strengthening the alloy matrix of the first hard phase, and thereby the wear resistance is improved and the falling off of the Mo silicide is prevented. In addition, it also has an effect in which the adhesion to the matrix is improved by dispersing in the matrix structure. Therefore, by these effects, it contributes to the improvement of the wear resistance. When the content of Ni is low, the above effect is insufficient. In contrast, when Ni is excessively contained therein, the compressibility is reduced due to powder hardening, and the wear resistance is deteriorated by austenitizing the matrix. Therefore, in the case in which it is selected as a first hard phase forming element, in the second embodiment of a wear resistant sintered member of the present invention, it is preferable that the content of Ni be 0.025 to 3.0% by mass, and in the third embodiment thereof, it is preferable that it be 0.025 to 2.5% by mass.

C: C acts to strengthen the matrix and contributes to improvement of the wear resistance. In addition, the third embodiment of a wear resistant sintered member of the present invention also has an effect of contributing to the improvement of the wear resistance by forming Cr carbide. When the content of C contained in the matrix is under 0.35% by mass, ferrite, in which both the wear resistance and strength are low, remains, and in contrast, when it exceeds 0.95% by mass, the strength is reduced due to precipitation of cementite at grain boundaries. Therefore, the content of C contained in the matrix is set to be 0.35 to 0.95% by mass. Furthermore, when the content of C in the second hard phase is under 0.01% by mass, in the overall composition, the carbide is not sufficiently formed and the improvement of the wear resistance is thereby insufficient. In contrast, when the content of C exceeds 0.72% by mass in the overall composition, the wear of a facing member is enhanced by increasing the amount of carbide formed. In addition, the compressibility is reduced by hardening of powder, the strength of the matrix is lowered, and the wear resistance is thereby decreased. Therefore, in the second embodiment of a wear resistant sintered member of the present invention, it is preferable that the content of C be 0.35 to 0.95% by mass, and in the third embodiment thereof, it is preferable that it be 0.36 to 1.67% by mass.

In the above third embodiment of a wear resistant sintered member of the present invention, the wear resistance of the second hard phase can be further improved by containing at least one of, by mass in the overall composition, Mo: 0.09 to 0.15%, V: 0.01 to 0.66%, and W: 0.05 to 1.5% in the second hard phase.

Mo contributes to the improvement of the wear resistance by forming carbide with C in the second hard phase forming powder and by forming a core in the second hard phase which consists of the Mo carbide and the above Cr carbide. In addition, Mo, which did not form the carbide, has an effect in which high temperature hardness and high temperature strength of the second hard phase are improved by dissolving in the second hard phase. When the content of Mo in the second hard phase is under 0.09% by mass in the overall composition, the above effect is insufficient, and in contrast, when it exceeds 0.15% by mass, the wear of a facing member is enhanced by increase in a precipitation amount of the carbide.

V contributes to the improvement in the wear resistance by forming fine carbide with C in the second hard phase forming powder. Furthermore, the above carbide has an effect which prevents Cr carbide from coarsening, the wear of a facing member is suppressed and the wear resistance is thereby improved. When the content of V in the second hard phase is under 0.01% by mass in the overall composition, the above effect is insufficient, and in contrast, when it exceeds 0.66% by mass, the wear of a facing member is enhanced by the increase in the precipitation amount of carbide.

W contributes to the improvement in the wear resistance by forming fine carbide with C in the second hard phase forming powder. In addition, the above carbide has an effect which prevents the Cr carbide from coarsening, and the wear of a facing member is suppressed and the wear resistance is thereby improved. When the content of W in the second hard phase is under 0.05% by mass in the overall composition, the above effect is insufficient, and in contrast, when it exceeds 1.5% by mass, the wear of a facing member is enhanced by increasing of a precipitation amount of the carbide.

The above wear resistant sintered members of the present invention are inexpensive because a Co-based hard phase is not used, and it has a wear resistance at the same level or greater than that of conventional materials.

First Manufacturing Process for Wear Resistant Sintered Member

A first manufacturing process for a wear resistant sintered member of the present invention comprises: mixing a first hard phase forming powder in an amount by mass of 5 to 25% comprising Si: 0.5 to 10%, Mo: 10 to 50%, at least one of Ni: 0.5 to 10% and Cr: 0.5 to 10% as necessary, and a balance of Fe and unavoidable impurities, a second hard phase forming powder in an amount of 5 to 30% comprising Cr: 4 to 25%, C: 0.25 to 2.4%, at least one of Mo: 0.3 to 3.0%, V: 0.2 to 2.2% and W: 1.0 to 5.0% as necessary, and a balance of Fe and unavoidable impurities, and a graphite powder in an amount of 0.35 to 0.95%, with an Fe-based matrix forming alloy powder; compacting in a desired shape; and sintering.

In the above first manufacturing process for a wear resistant sintered member of the present invention, an Fe-based alloy powder is not particularly limited, and conventional powders (an Fe-based alloy powder, a mixed powder of at least two Fe-based alloy powders, a mixed powder or a partially diffused alloy powder between an Fe-based alloy powder or an Fe powder and another metal powder or another alloy powder, etc.), can be employed. In addition, it is suitable that sintering conditions be 1100 to 1200 C. for 30 minutes to 2 hours, which is generally used.

Second Manufacturing Process for Wear Resistant Sintered Member

A second manufacturing process for a wear resistant sintered member of the present invention comprises: mixing a first hard phase forming powder in an amount by mass of 5 to 30% comprising Si: 0.5 to 10%, Mo: 10 to 50%, at least one of Ni: 0.5 to 10% and Cr: 0.5 to 10%, and a balance of Fe and unavoidable impurities, and a graphite powder in an amount of 0.35 to 0.95%, with a matrix forming alloy powder comprising Mo: 0.8 to 4.2%, and a balance of Fe and unavoidable impurities; compacting in a desired shape; and sintering.

Third Manufacturing Process for Wear Resistant Sintered Member

A third manufacturing process for a wear resistant sintered member of the present invention comprises: mixing a first hard phase forming powder in an amount by mass of 5 to 25% comprising Si: 0.5 to 10%, Mo: 10 to 50%, at least one of Ni: 0.5 to 10% and Cr: 0.5 to 10% as necessary, and a balance of Fe and unavoidable impurities, a second hard phase forming powder in an amount of 5 to 30% comprising Cr: 4 to 25%, C: 0.25 to 2.4%, at least one of Mo: 0.3 to 3.0%, V: 0.2 to 2.2% and W: 1.0 to 5.0% as necessary, and a balance of Fe and unavoidable impurities, and a graphite powder in an amount of 0.35 to 0.95%, with a matrix forming alloy powder comprising Mo: 0.8 to 4.2%, and a balance of Fe and unavoidable impurities; compacting in a desired shape; and sintering.

Fourth Manufacturing Process for Wear Resistant Sintered Member

A fourth manufacturing process for a wear resistant sintered member of the present invention is characterized in that a matrix forming mixed powder which mixes, by mass, an Fe—Cr-based alloy powder in an amount 60% or less comprising Cr: 2 to 4%, Mo: 0.2 to 0.4%, V: 0.2 to 0.4%, and a balance of Fe and unavoidable impurities, with an Fe—Mo-based alloy powder comprising Mo: 0.8 to 4.2%, and a balance of Fe and unavoidable impurities, is used, instead of the matrix forming alloy powders used in the above first to third manufacturing processes.

In the following, the bases of the numerical limitations of the above component compositions will be explained.

Matrix Forming Alloy Powder (Fe—Mo-based Alloy Powder)

A matrix structure using a matrix forming alloy powder (Fe—Mo-based alloy powder) is bainite. Bainite is a metallographic structure having a high hardness and a high strength and is superior in wear resistance. Furthermore, in the present invention, since Mo is contained in the matrix, the wear resistance is also improved by precipitating fine Mo carbide. The above matrix forming alloy powder is also superior in the adhesion in the first hard phase, and it constitutes a matrix of an alloy in the present invention. In addition, when the second hard phase is contained, the hardenability of the matrix is improved by Cr which migrated from the second hard phase, and a mixed phase of bainite and martensite is formed by martensite produced in the region, so that the wear resistance is further improved.

Mo: Mo has an effect in which the matrix is strengthened by dissolving therein and in which hardenability of the matrix structure is improved, and contributes to improving the strength and the wear resistance of the matrix by such effects. Furthermore, the first hard phase forming powder is an Fe—Mo-based alloy powder as described below and the matrix forming powder is also an Fe—Mo-based alloy powder, and therefore, the adhesion of the first hard phase forming powder to the matrix is superior. However, when the content of Mo is under 0.8% by mass, the strength of the matrix is insufficient, and in contrast, when it exceeds 4.2% by mass, the compressibility is decreased by hardening of the powder. Therefore, the content of Mo is set to be 0.8 to 4.2% by mass.

Matrix Forming Mixed Powder

The matrix forming mixed powder is a mixed powder which mixes an Fe—Cr-based alloy powder in an amount of 60% by mass or less with an Fe—Mo-based alloy powder used as the above matrix forming alloy powder. In an area using the Fe—Cr-based alloy powder, an oxide film is easily formed, and therefore, the clumping resistance is improved, and it is effective for improvement of the wear resistance in an engine in which metallic contacts frequently occur.

Cr: Cr is an element in which the matrix is strengthened by dissolving therein and the wear resistance is thereby improved and in which hardenability of the matrix structure is improved. When the content of Cr dissolved in the Fe—Cr-based alloy powder is under 2% by mass of the total mass of the Fe—Cr-based alloy powder, the above effects are insufficient, and in contrast, when it exceeds 4% by mass, the compressibility is reduced by hardening of the powder, and therefore, the content of Cr is set to be 2 to 4% by mass.

Mo and V: Mo and V have an effect in which the matrix is strengthened by dissolving therein and the strength is thereby improved. When the content of Mo and V dissolved in the Fe—Cr-based alloy powder is under 0.2% by mass to the total mass of the Fe—Cr-based alloy powder, the effect is insufficient, and in contrast, when it exceeds 0.4% by mass, the compressibility is decreased by hardening of the powder. Therefore, the content of Mo and V is set to be 0.2 to 0.4% by mass, respectively.

Furthermore, it is preferable that the content of the Fe—Cr-based alloy powder in the matrix forming mixed powder be 60% by mass or less. When it exceeds 60% by mass, the wear resistance is decreased by reduction of the area of Mo steel in the matrix, and in addition, the machinability is also reduced by increasing of a martensite phase.

Graphite Powder

In the case in which C is strengthened by dissolving in the matrix forming alloy powder, the compressibility is reduced by hardening of the alloy powder, and therefore, C is added in a form of graphite powder. C added in a form of graphite powder strengthens the matrix and improves the wear resistance. When the content of C is under 0.35% by mass, ferrite in which both the wear resistance and the strength are low remains in the matrix structure, and in contrast, when it exceeds 0.95% by mass, cementite precipitates at grain boundaries and the strength is reduced. Therefore, the content of added graphite is set to be 0.35 to 0.95% by mass of the total mass of a premixed powder.

First Hard Phase Forming Powder

The first hard phase formed by a first hard phase forming powder exhibits a form in which Mo silicide particles disperse in an alloy matrix of the first hard phase between Fe and at least one of Ni and Cr, and contributes to improvement in the wear resistance.

Mo in the first hard phase forming powder forms hard Mo silicide by binding mainly with Si, and contributes to improvement in the wear resistance by forming a core of the first hard phase. In addition, it also has an effect which firmly adheres the first hard phase to the matrix by dispersing in the matrix. When the content of Mo is under 10% by mass in the overall composition of the first hard phase forming powder, silicide is insufficiently precipitated, and in contrast, when it exceeds 50% by mass, the strength of the hard phase is reduced by the increase in the precipitated amount of the silicide, and therefore, parts thereof chip off during use and the chips act as a grinding powder and the wear amount increases. Therefore, the content of Mo is set to be 10 to 50% by mass.

Si in the first hard phase forming powder forms hard Mo silicide by binding with Mo as described above and contributes to improvement in the wear resistance by forming a core of the first hard phase. When the content of Si in the first hard phase forming powder is under 0.5% by mass in the overall composition of the powder, the silicide is insufficiently precipitated, and in contrast, when it exceeds 10% by mass, the compressibility is decreased by hardening of the powder and the adhesion to the matrix is deteriorated by firmly forming an oxide film on the surface of the powder. Therefore, the content of Si is set to be 0.5 to 10% by mass.

Cr and Ni in the first hard phase forming powder has an effect which strengthens the matrix of Mo silicide in the first hard phase and improves the hardness of the first hard phase, and an effect which prevents the Mo silicide from falling off, by adding at least one of the elements. In addition, it has an effect which improves the adhesion to the matrix structure by dispersing in the matrix structure. Therefore, it contributes to improvement of the wear resistance by these effects. When the content of Cr and Ni in the first hard phase forming powder is under 0.5% by mass in the overall composition of the powder, respectively, the above effects are insufficient. Furthermore, when the content of Cr exceeds 10% by mass, the compressibility is deteriorated by hardening of the powder and the adhesion to the matrix is reduced by firmly forming an oxide film on the surface of the powder. In addition, when the content of Ni exceeds 10% by mass, the compressibility is decreased by hardening of the powder and the wear resistance is deteriorated by austenitizing the matrix. Therefore, the content of Cr and Ni in the first hard phase forming powder is set to be 0.5 to 10% by mass, respectively.

When the content of the first hard phase forming powder having the above composition is under 5% by mass to the overall mass of the mixed powder, the amount of the first hard phase formed is insufficient, and it thereby does not contribute to improvement of the wear resistance. In the case of the second embodiment of a wear resistant sintered material of the present invention using only the first hard phase forming powder as a hard phase forming powder, when an amount of the first hard phase forming powder added exceeds 30% by mass to the total mass of the mixed powder, the wear resistant sintered material is hard; however, adverse effects occur such as decrease in the strength of materials, reduction of compressibility, etc., by increasing of a phase having a low toughness. Furthermore, in the case of the first or third embodiment of a wear resistant sintered member of the present invention using a second hard phase forming powder as described below as a hard phase forming powder, in addition to the first hard phase forming powder, when an addition amount of the first hard phase forming powder exceeds 25% by mass to the total mass of the mixed powder, the above adverse effects occur by a synergistic effect due to the two hard phase forming powders.

Second Hard Phase Forming Powder

The second hard phase forming powder is used in order to disperse a second hard phase, in which a ferrite phase or a mixed phase of ferrite and austenite having a higher Cr concentration than that of a matrix structure thereof surrounds a core consisting of Cr carbide particles, in a matrix structure in the first or third embodiment of a wear resistant sintered member of the present invention.

Cr in the second hard phase forming powder forms Cr carbide with C in the second hard phase forming powder and contributes to improvement of the wear resistance by forming a core of the second hard phase. Furthermore, a part of Cr migrates to the matrix and acts to strengthen the matrix and the second hard phase, and it thereby contributes to improvement of the wear resistance of the overall sintered alloy. In addition, in an area having a high Cr concentration surrounding the second hard phase, a ferrite phase is formed and it thereby contributes to an effect which buffers impacts on a valve seating. When the content of Cr in the second hard phase forming powder is under 4% by mass in the overall composition of the powder, Cr carbide is insufficiently formed, and this does not contribute to the wear resistance. In contrast, when it exceeds 25% by mass, the amount of the carbide formed increases, and the wear of a facing member is increased and the compressibility is decreased by increasing of the hardness of the powder. In addition, the wear resistance is also reduced by increasing of the content of the mixed phase of ferrite and austenite. Therefore, the content of Cr in the second hard phase forming powder is set to be 4 to 25% by mass.

C in the second hard phase forming powder forms Cr carbide with the above Cr and contributes to improvement of the wear resistance by forming a core of the second hard phase. When the content of C is under 0.25% by mass in the overall composition of the powder, the carbide is insufficiently formed and does not contribute to improvement of the wear resistance, and in contrast, when it exceeds 2.4% by mass, the wear of a facing member is increased by increasing of the amount of the carbide formed and the compressibility is reduced by the increase in the hardness of the powder. Therefore, the content of C in the second hard phase forming powder is set to be 0.25 to 2.4% by mass.

In the above second hard phase forming powder, if at least one of, by mass, Mo: 0.3 to 3.0%, V: 0.2 to 2.2%, and W: 1.0 to 5.0% is contained, it is possible to further increase an effect of improvement of the wear resistance of the second hard phase.

Mo contributes to the improvement of the wear resistance by forming carbide with C in the second hard phase forming powder and by forming a core in the second hard phase which consists of the Mo carbide and the above Cr carbide. In addition, Mo which did not form the carbide has an effect in which high temperature hardness and high temperature strength of the second hard phase are improved by dissolving in the second hard phase. When the content of Mo in the second hard phase forming powder is under 0.3% by mass in the overall composition, the above effect is insufficient, and in contrast, when it exceeds 3% by mass, the wear of a facing member is enhanced by increasing a precipitation amount of the carbide.

V contributes to the improvement in the wear resistance by forming fine carbide with C in the second hard phase forming powder. Furthermore, the above carbide has an effect which prevents Cr carbide from coarsening, the wear of a facing member is suppressed and the wear resistance is thereby improved. When the content of V in the second hard phase forming powder is under 0.2% by mass in the overall composition, the above effect is insufficient, and in contrast, when it exceeds 2.2% by mass, the wear of a facing member is enhanced by increasing of a precipitation amount of carbide.

W contributes to the improvement in the wear resistance by forming fine carbide with C in the second hard phase forming powder. In addition, the above carbide has an effect which prevents the Cr carbide from coarsening, and the wear of a facing member is suppressed and the wear resistance is thereby improved. When the content of W in the second hard phase forming powder is under 1.0% by mass in the overall composition, the above effect is insufficient, and in contrast, when it exceeds 5.0% by mass, the wear of a facing member is enhanced by increasing of the precipitation amount of the carbide.

When the amount which is added of the second hard phase forming powder having the above composition is under 5% by mass to the total mass of the mixed powder, the amount of the hard phase which is formed is insufficient, and the second hard phase forming powder does not contribute to the wear resistance, and in contrast, even if it exceeds 30% by mass, not only is further improvement of the wear resistance not obtained, but also problems occur such as decreasing of the strength of materials, lowering of the compressibility, etc., by increasing of a ferrite phase which is soft and has a higher Cr concentration than that of the matrix structure. Therefore, the content is set to be 5 to 30% by mass in total mass of the mixed powder.

Machinability Improving Component

In the above metallographic structures of the first to third embodiments of a wear resistant sintered member of the present invention, it is preferable that a machinability improving component be dispersed in an amount of 0.3 to 2.0% by mass. As a machinability improving component, at least one of lead, molybdenum disulfide, manganese sulfide, boron nitride, calcium fluoride, and magnesium metasilicate mineral, can be employed. The machinability improving component serves as an initiating point of chip breaking in a cutting operation by dispersing in the matrix, and machinability of the sintered alloy can be improved.

Such machinability improving component is obtained by adding a machinability improving component powder consisting of at least one of lead powder, molybdenum disulfide powder, manganese sulfide powder, boron nitride powder, calcium fluoride powder, and magnesium metasilicate mineral powder in an amount of 0.3 to 2.0% by mass to the mixed powder. When the content of the machinability improving component, that is, the addition amount of the machinability improving component powder, is under 0.3% by mass, the effect is insufficient, and in contrast, when the content exceeds 2.0% by mass, the machinability improving component inhibits diffusion of powders during sintering, and thereby the strength of sintered alloy is lowered. Therefore, the content of the machinability improving component, (the addition amount of the machinability improving component powder) is set to be 0.3 to 2.0% by mass.

Lead, Lead Alloy, Copper, Copper Alloy, or Acrylic Resin

It is preferable that lead, lead alloy, copper, copper alloy, or acrylic resin be filled in pores of the above wear resistant sintered member. These are also machinability improving components. In particular, when a sintered alloy having pores is cut, it is cut intermittently; however, by having the pores filled with the above component, such a sintered alloy can be cut in a continuous manner, and this prevents shocks from being applied to the edge of the cutting tool. The lead and the lead alloy serve as a solid lubricant, the copper and the copper alloy serve to prevent heat from being accumulated and for reducing damage to the edge of the cutting tool by heating since thermal conductivity is high, and the acrylic resin serves as an initiating point of chip breaking in a cutting operation.

The machinability improving component can be filled by infiltrating or impregnating one of lead, lead alloy, copper, copper alloy, and acrylic resin, in pores of a wear resistant sintered member obtained by the above manufacturing process for a wear resistant sintered member.

DETAILED DESCRIPTION OF THE PREFERRED EMBODIMENTS

Figure 1:
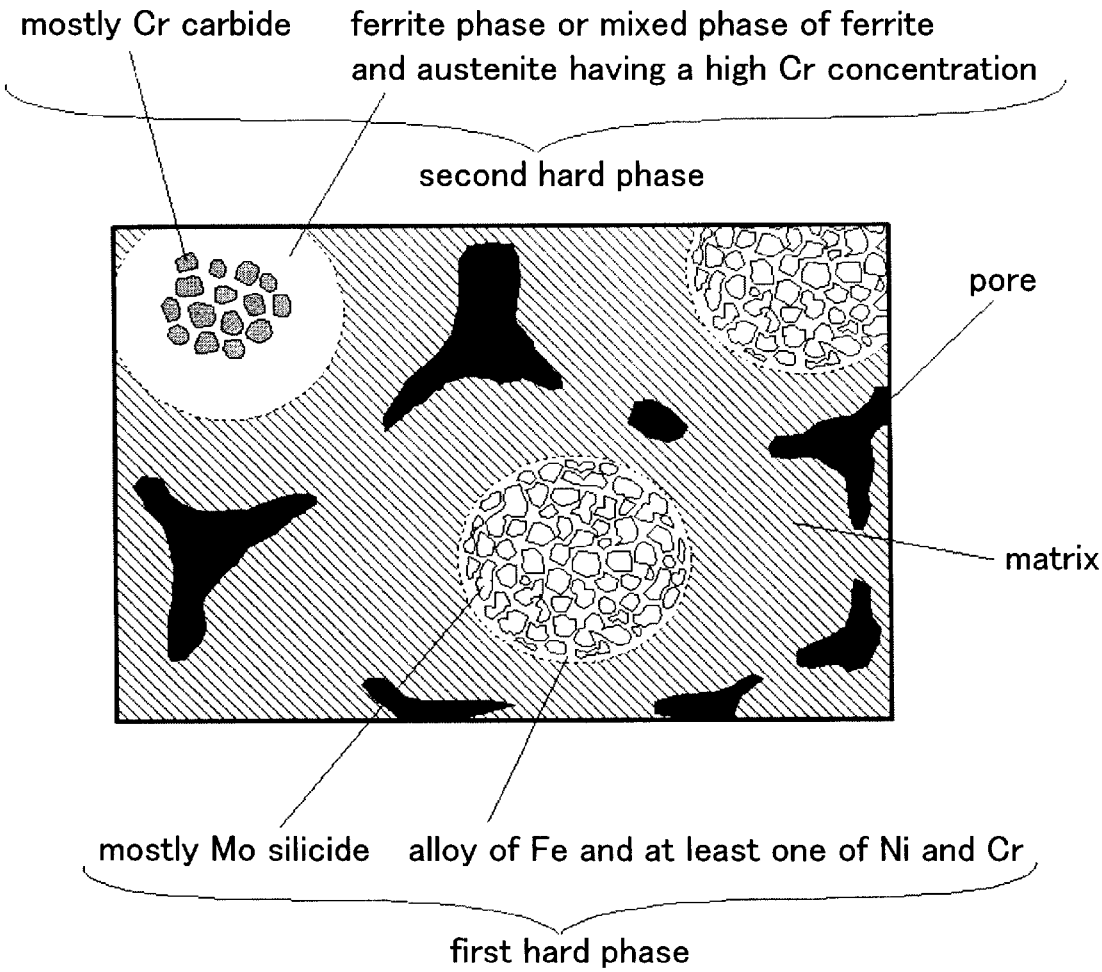
FIG. 1 is a view schematically showing a metallographic structure of a first embodiment of a wear resistant sintered member according to the present invention.
Figure 2:
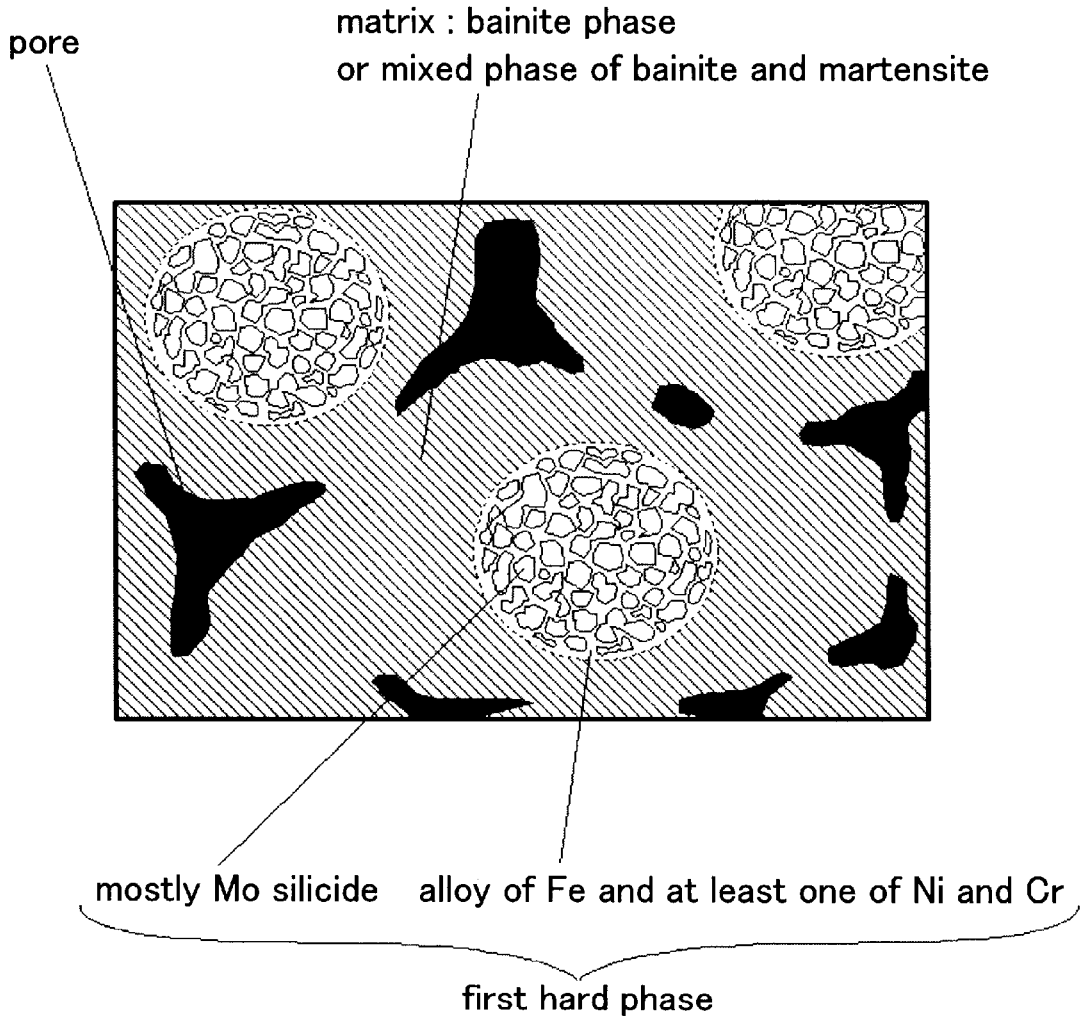
FIG. 2 is a view schematically showing a metallographic structure of a second embodiment of a wear resistant sintered member according to the present invention.
Figure 3:
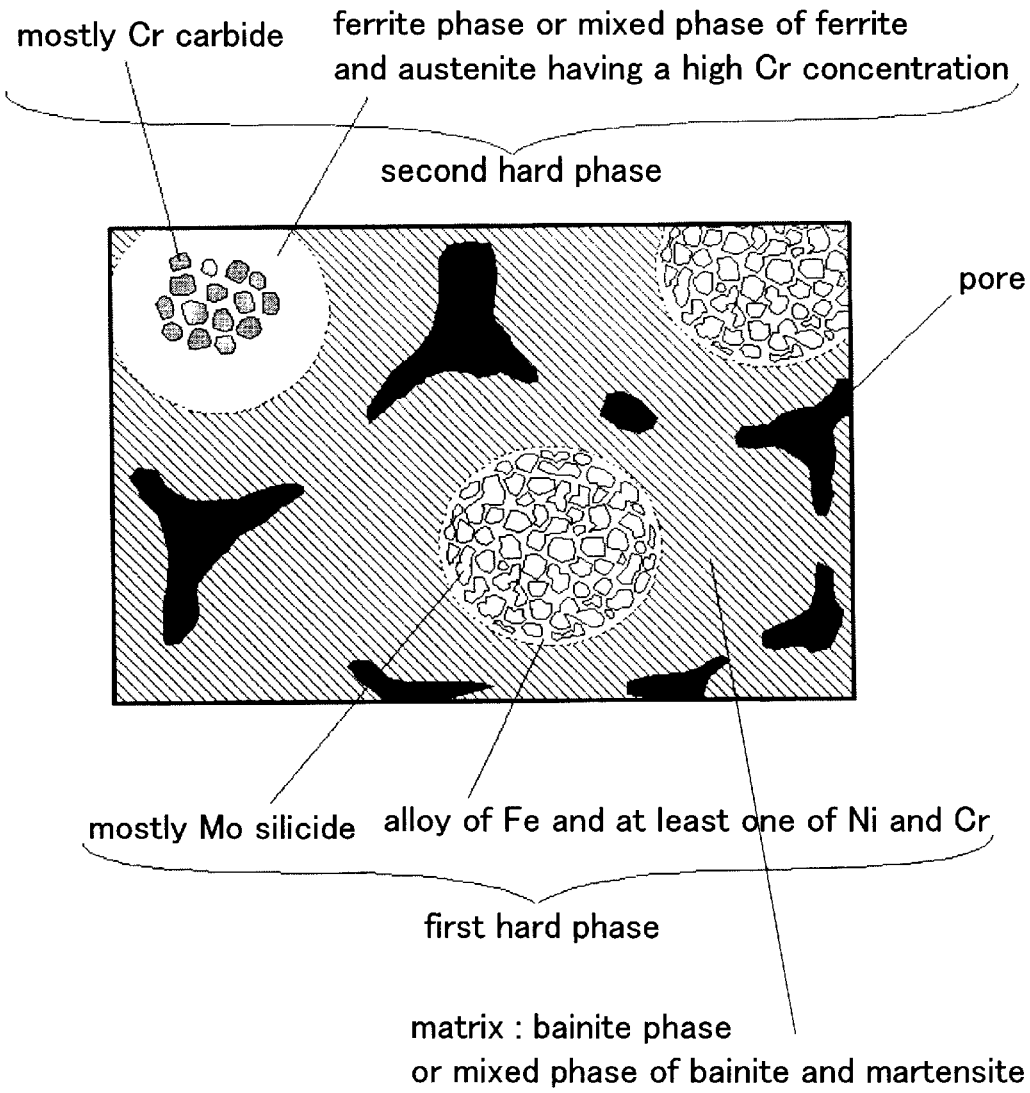
FIG. 3 is a view schematically showing a metallographic structure of a third embodiment of a wear resistant sintered member according to the present invention.

In the following, Examples of the present invention will be explained.

First Example

A matrix forming powder and a first hard phase forming powder consisting of compositions shown in Table 1 were mixed with a graphite powder at compounding ratios shown in Table 1, and therefore, powders (samples numbers G01 to G51) consisting of overall compositions shown in Table 2 were produced. Next, these mixed powder were compacted into a shape of valve seat insert having outer diameters of 50 mm, inner diameters of 45 mm, and thicknesses of 10 mm, at a compacting pressure of 6.5 ton/cm$^2$, and these compacts were sintered by heating at 1130° C. for 60 minutes in a dissociated ammonia gas atmosphere, and sintered alloy samples were thereby formed. The alloy of sample number G52 is an alloy disclosed in the Japanese Patent Publication No. 5-55593 mentioned in the related art.

TABLE 1

| Sample No. | Powder Mixing Ratio wt % | | | | | | | | | | Comments |
|---|---|---|---|---|---|---|---|---|---|---|---|
| | Matrix Forming Powder | | | First Hard Phase Forming Powder | | | | | | Graphite Powder | |
| | | Composition wt % | | | Composition wt % | | | | | | |
| | | Fe | Mo | | Fe | Mo | Si | Cr | Ni | | |
| G01 | Balance | Balance | 0.50 | 15.00 | Balance | 35.00 | 1.50 | 3.50 | 3.00 | 0.65 | Outside lower limit of Mo content in matrix forming powder |
| G02 | Balance | Balance | 0.80 | 15.00 | Balance | 35.00 | 1.50 | 3.50 | 3.00 | 0.65 | Within lower limit of Mo content in matrix forming powder |
| G03 | Balance | Balance | 1.20 | 15.00 | Balance | 35.00 | 1.50 | 3.50 | 3.00 | 0.65 | |
| G04 | Balance | Balance | 2.00 | 15.00 | Balance | 35.00 | 1.50 | 3.50 | 3.00 | 0.65 | |
| G05 | Balance | Balance | 3.00 | 15.00 | Balance | 35.00 | 1.50 | 3.50 | 3.00 | 0.65 | |
| G06 | Balance | Balance | 4.20 | 15.00 | Balance | 35.00 | 1.50 | 3.50 | 3.00 | 0.65 | Within upper limit of Mo content in matrix forming powder |
| G07 | Balance | Balance | 5.00 | 15.00 | Balance | 35.00 | 1.50 | 3.50 | 3.00 | 0.65 | Outside upper limit of Mo content in matrix forming powder |
| G08 | Balance | Balance | 3.00 | 15.00 | Balance | 5.00 | 1.50 | 3.50 | 3.00 | 0.65 | Outside lower limit of Mo content in 1st hard phase forming powder |
| G09 | Balance | Balance | 3.00 | 15.00 | Balance | 10.00 | 1.50 | 3.50 | 3.00 | 0.65 | Within lower limit of Mo content in 1st hard phase forming powder |

TABLE 1-continued

| Sample No. | Powder Mixing Ratio wt % | | | | | | | | | | Comments |
|---|---|---|---|---|---|---|---|---|---|---|---|
| | Matrix Forming Powder | | | First Hard Phase Forming Powder | | | | | | Graphite Powder | |
| | Composition wt % | | | Composition wt % | | | | | | | |
| | | Fe | Mo | | Fe | Mo | Si | Cr | Ni | | |
| G10 | Balance | Balance | 3.00 | 15.00 | Balance | 20.00 | 1.50 | 3.50 | 3.00 | 0.65 | |
| G11 | Balance | Balance | 3.00 | 15.00 | Balance | 45.00 | 1.50 | 3.50 | 3.00 | 0.65 | |
| G12 | Balance | Balance | 3.00 | 15.00 | Balance | 50.00 | 1.50 | 3.50 | 3.00 | 0.65 | Within upper limit of Mo content in 1st hard phase forming powder |
| G13 | Balance | Balance | 3.00 | 15.00 | Balance | 60.00 | 1.50 | 3.50 | 3.00 | 0.65 | Outside upper limit of Mo content in 1st hard phase forming powder |
| G14 | Balance | Balance | 3.00 | 15.00 | Balance | 35.00 | 0.20 | 3.50 | 3.00 | 0.65 | Outside lower limit of Si content in 1st hard phase forming powder |
| G15 | Balance | Balance | 3.00 | 15.00 | Balance | 35.00 | 0.50 | 3.50 | 3.00 | 0.65 | Within lower limit of Si content in 1st hard phase forming powder |
| G16 | Balance | Balance | 3.00 | 15.00 | Balance | 35.00 | 3.00 | 3.50 | 3.00 | 0.65 | |
| G17 | Balance | Balance | 3.00 | 15.00 | Balance | 35.00 | 5.00 | 3.50 | 3.00 | 0.65 | |
| G18 | Balance | Balance | 3.00 | 15.00 | Balance | 35.00 | 7.50 | 3.50 | 3.00 | 0.65 | |
| G19 | Balance | Balance | 3.00 | 15.00 | Balance | 35.00 | 10.00 | 3.50 | 3.00 | 0.65 | Within upper limit of Si content in 1st hard phase forming powder |
| G20 | Balance | Balance | 3.00 | 15.00 | Balance | 35.00 | 12.00 | 3.50 | 3.00 | 0.65 | Outside upper limit of Si content in 1st hard phase forming powder |
| G21 | Balance | Balance | 3.00 | 15.00 | Balance | 35.00 | 1.50 | | | 0.65 | |
| G22 | Balance | Balance | 3.00 | 15.00 | Balance | 35.00 | 1.50 | 0.20 | | 0.65 | Outside lower limit of Cr content in 1st hard phase forming powder |
| G23 | Balance | Balance | 3.00 | 15.00 | Balance | 35.00 | 1.50 | 0.50 | | 0.65 | Within lower limit of Cr content in 1st hard phase forming powder |
| G24 | Balance | Balance | 3.00 | 15.00 | Balance | 35.00 | 1.50 | 1.00 | | 0.65 | |
| G25 | Balance | Balance | 3.00 | 15.00 | Balance | 35.00 | 1.50 | 3.50 | | 0.65 | |
| G26 | Balance | Balance | 3.00 | 15.00 | Balance | 35.00 | 1.50 | 5.00 | | 0.65 | |
| G27 | Balance | Balance | 3.00 | 15.00 | Balance | 35.00 | 1.50 | 7.50 | | 0.65 | |
| G28 | Balance | Balance | 3.00 | 15.00 | Balance | 35.00 | 1.50 | 10.00 | | 0.65 | Within upper limit of Cr content in 1st hard phase forming powder |
| G29 | Balance | Balance | 3.00 | 15.00 | Balance | 35.00 | 1.50 | 12.00 | | 0.65 | Outside upper limit of Cr content in 1st hard phase forming powder |
| G30 | Balance | Balance | 3.00 | 15.00 | Balance | 35.00 | 1.50 | | 0.20 | 0.65 | Outside lower limit of Ni content in 1st hard phase forming powder |
| G31 | Balance | Balance | 3.00 | 15.00 | Balance | 35.00 | 1.50 | | 0.50 | 0.65 | Within lower limit of Ni content in 1st hard phase forming powder |
| G32 | Balance | Balance | 3.00 | 15.00 | Balance | 35.00 | 1.50 | | 1.00 | 0.65 | |
| G33 | Balance | Balance | 3.00 | 15.00 | Balance | 35.00 | 1.50 | | 3.00 | 0.65 | |
| G34 | Balance | Balance | 3.00 | 15.00 | Balance | 35.00 | 1.50 | | 5.00 | 0.65 | |
| G35 | Balance | Balance | 3.00 | 15.00 | Balance | 35.00 | 1.50 | | 7.50 | 0.65 | |
| G36 | Balance | Balance | 3.00 | 15.00 | Balance | 35.00 | 1.50 | | 10.00 | 0.65 | Within upper limit of Ni content in 1st hard phase forming powder |
| G37 | Balance | Balance | 3.00 | 15.00 | Balance | 35.00 | 1.50 | | 12.00 | 0.65 | Outside upper limit of Ni content in 1st hard phase forming powder |
| G38 | Balance | Balance | 3.00 | 15.00 | Balance | 35.00 | 1.50 | 10.00 | 10.00 | 0.65 | Within lower limit of Cr and Ni content in 1st hard phase forming powder |
| G39 | Balance | Balance | 3.00 | 3.00 | Balance | 35.00 | 1.50 | 3.50 | 3.00 | 0.65 | Outside lower limit of addition amount of 1st hard phase forming powder |
| G40 | Balance | Balance | 3.00 | 5.00 | Balance | 35.00 | 1.50 | 3.50 | 3.00 | 0.65 | Within lower limit of addition amount of 1st hard phase forming powder |
| G41 | Balance | Balance | 3.00 | 10.00 | Balance | 35.00 | 1.50 | 3.50 | 3.00 | 0.65 | |
| G42 | Balance | Balance | 3.00 | 20.00 | Balance | 35.00 | 1.50 | 3.50 | 3.00 | 0.65 | |
| G43 | Balance | Balance | 3.00 | 25.00 | Balance | 35.00 | 1.50 | 3.50 | 3.00 | 0.65 | |
| G44 | Balance | Balance | 3.00 | 30.00 | Balance | 35.00 | 1.50 | 3.50 | 3.00 | 0.65 | Within upper limit of addition amount of 1st hard phase forming powder |
| G45 | Balance | Balance | 3.00 | 35.00 | Balance | 35.00 | 1.50 | 3.50 | 3.00 | 0.65 | Outside upper limit of addition amount of 1st hard phase forming powder |
| G46 | Balance | Balance | 3.00 | 15.00 | Balance | 35.00 | 1.50 | 3.50 | 3.00 | 0.20 | Outside lower limit of addition amount of graphite powder |
| G47 | Balance | Balance | 3.00 | 15.00 | Balance | 35.00 | 1.50 | 3.50 | 3.00 | 0.35 | Within lower limit of addition amount of graphite powder |
| G48 | Balance | Balance | 3.00 | 15.00 | Balance | 35.00 | 1.50 | 3.50 | 3.00 | 0.50 | |
| G49 | Balance | Balance | 3.00 | 15.00 | Balance | 35.00 | 1.50 | 3.50 | 3.00 | 0.80 | |
| G50 | Balance | Balance | 3.00 | 15.00 | Balance | 35.00 | 1.50 | 3.50 | 3.00 | 0.95 | Within upper limit of addition amount of graphite powder |
| G51 | Balance | Balance | 3.00 | 15.00 | Balance | 35.00 | 1.50 | 3.50 | 3.00 | 1.00 | Outside upper limit of addition amount of graphite powder |
| G52 | Fe-6.5Co-1.5Mo-1.5Ni: Balance | | | | Co-28Mo-8Cr-2.5Si: Balance | | | | | 1.00 | Alloy disclosed in Japanese Patent Publication No. 5-55593 |

TABLE 2

| Sample | Overall Composition wt % | | | | | | | |
|---|---|---|---|---|---|---|---|---|
| No. | Fe | Mo | Si | Cr | Ni | Co | C | Comments |
| G01 | Balance | 5.67 | 0.23 | 0.53 | 0.45 | | 0.65 | Outside lower limit of Mo content in matrix forming powder |
| G02 | Balance | 5.92 | 0.23 | 0.53 | 0.45 | | 0.65 | Within lower limit of Mo content in matrix forming powder |
| G03 | Balance | 6.26 | 0.23 | 0.53 | 0.45 | | 0.65 | |
| G04 | Balance | 6.94 | 0.23 | 0.53 | 0.45 | | 0.65 | |
| G05 | Balance | 7.78 | 0.23 | 0.53 | 0.45 | | 0.65 | |
| G06 | Balance | 8.79 | 0.23 | 0.53 | 0.45 | | 0.65 | Within upper limit of Mo content in matrix forming powder |
| G07 | Balance | 9.47 | 0.23 | 0.53 | 0.45 | | 0.65 | Outside upper limit of Mo content in matrix forming powder |
| G08 | Balance | 3.28 | 0.23 | 0.53 | 0.45 | | 0.65 | Outside lower limit of Mo content in 1st hard phase forming powder |
| G09 | Balance | 4.03 | 0.23 | 0.53 | 0.45 | | 0.65 | Within lower limit of Mo content in 1st hard phase forming powder |
| G10 | Balance | 5.53 | 0.23 | 0.53 | 0.45 | | 0.65 | |
| G11 | Balance | 9.28 | 0.23 | 0.53 | 0.45 | | 0.65 | |
| G12 | Balance | 10.03 | 0.23 | 0.53 | 0.45 | | 0.65 | Within upper limit of Mo content in 1st hard phase forming powder |
| G13 | Balance | 11.53 | 0.23 | 0.53 | 0.45 | | 0.65 | Outside upper limit of Mo content in 1st hard phase forming powder |
| G14 | Balance | 7.78 | 0.03 | 0.53 | 0.45 | | 0.65 | Outside lower limit of Si content in 1st hard phase forming powder |
| G15 | Balance | 7.78 | 0.08 | 0.53 | 0.45 | | 0.65 | Within lower limit of Si content in 1st hard phase forming powder |
| G16 | Balance | 7.78 | 0.45 | 0.53 | 0.45 | | 0.65 | |
| G17 | Balance | 7.78 | 0.75 | 0.53 | 0.45 | | 0.65 | |
| G18 | Balance | 7.78 | 1.13 | 0.53 | 0.45 | | 0.65 | |
| G19 | Balance | 7.78 | 1.50 | 0.53 | 0.45 | | 0.65 | Within upper limit of Si content in 1st hard phase forming powder |
| G20 | Balance | 7.78 | 1.80 | 0.53 | 0.45 | | 0.65 | Outside upper limit of Si content in 1st hard phase forming powder |
| G21 | Balance | 5.25 | 0.23 | 0.00 | 0.00 | | 0.65 | |
| G22 | Balance | 7.78 | 0.23 | 0.03 | 0.00 | | 0.65 | Outside lower limit of Cr content in 1st hard phase forming powder |
| G23 | Balance | 7.78 | 0.23 | 0.08 | 0.00 | | 0.65 | Within lower limit of Cr content in 1st hard phase forming powder |
| G24 | Balance | 7.78 | 0.23 | 0.15 | 0.00 | | 0.65 | |
| G25 | Balance | 7.78 | 0.23 | 0.53 | 0.00 | | 0.65 | |
| G26 | Balance | 7.78 | 0.23 | 0.75 | 0.00 | | 0.65 | |
| G27 | Balance | 7.78 | 0.23 | 1.13 | 0.00 | | 0.65 | |
| G28 | Balance | 7.78 | 0.23 | 1.50 | 0.00 | | 0.65 | Within upper limit of Cr content in 1st hard phase forming powder |
| G29 | Balance | 7.78 | 0.23 | 1.80 | 0.00 | | 0.65 | Outside upper limit of Cr content in 1st hard phase forming powder |
| G30 | Balance | 7.78 | 0.23 | 0.00 | 0.03 | | 0.65 | Outside lower limit of Ni content in 1st hard phase forming powder |
| G31 | Balance | 7.78 | 0.23 | 0.00 | 0.08 | | 0.65 | Within lower limit of Ni content in 1st hard phase forming powder |
| G32 | Balance | 7.78 | 0.23 | 0.00 | 0.15 | | 0.65 | |
| G33 | Balance | 7.78 | 0.23 | 0.00 | 0.45 | | 0.65 | |
| G34 | Balance | 7.78 | 0.23 | 0.00 | 0.75 | | 0.65 | |
| G35 | Balance | 7.78 | 0.23 | 0.00 | 1.13 | | 0.65 | |
| G36 | Balance | 7.78 | 0.23 | 0.00 | 1.50 | | 0.65 | Within upper limit of Ni content in 1st hard phase forming powder |
| G37 | Balance | 7.78 | 0.23 | 0.00 | 1.80 | | 0.65 | Outside upper limit of Ni content in 1st hard phase forming powder |
| G38 | Balance | 7.78 | 0.23 | 1.50 | 1.50 | | 0.65 | Within lower limit of Cr and Ni contents in 1st hard phase forming powder |
| G39 | Balance | 3.94 | 0.05 | 0.11 | 0.09 | | 0.65 | Outside lower limit of addition amount in 1st hard phase forming powder |
| G40 | Balance | 4.58 | 0.08 | 0.18 | 0.15 | | 0.65 | Within lower limit of addition amount in 1st hard phase forming powder |
| G41 | Balance | 6.18 | 0.15 | 0.35 | 0.30 | | 0.65 | |
| G42 | Balance | 9.38 | 0.30 | 0.70 | 0.60 | | 0.65 | |
| G43 | Balance | 10.98 | 0.38 | 0.88 | 0.75 | | 0.65 | |
| G44 | Balance | 12.58 | 0.45 | 1.05 | 0.90 | | 0.65 | Within upper limit of addition amount in 1st hard phase forming powder |
| G45 | Balance | 14.18 | 0.53 | 1.23 | 1.05 | | 0.65 | Outside upper limit of addition amount in 1st hard phase forming powder |
| G46 | Balance | 7.79 | 0.23 | 0.53 | 0.45 | | 0.20 | Outside lower limit of addition amount of graphite powder |
| G47 | Balance | 7.79 | 0.23 | 0.53 | 0.45 | | 0.35 | Within lower limit of addition amount of graphite powder |

TABLE 2-continued

| Sample No. | Overall Composition wt % Fe | Mo | Si | Cr | Ni | Co | C | Comments |
|---|---|---|---|---|---|---|---|---|
| G48 | Balance | 7.79 | 0.23 | 0.53 | 0.45 | | 0.50 | |
| G49 | Balance | 7.78 | 0.23 | 0.53 | 0.45 | | 0.80 | |
| G50 | Balance | 7.77 | 0.23 | 0.53 | 0.45 | | 0.95 | Within upper limit of addition amount of graphite powder |
| G51 | Balance | 7.77 | 0.23 | 0.53 | 0.45 | | 1.00 | Outside upper limit of addition amount of graphite powder |
| G52 | Balance | 5.46 | 0.38 | 1.20 | 1.26 | 14.69 | 1.00 | Alloy disclosed in Japanese Patent Publication No. 5-55593 |

With respect to the samples of samples numbers G01 to G52, area ratios of Mo silicide particles were measured and simple wear tests were carried out, and the results are shown in Table 3 and FIGS. 4 to 10. The area ratios of the Mo silicide particles were measured by the total area inside the outline of the Mo silicide particles using an image analysis apparatus (produced by Keyence Co., Ltd.), with respect to the samples which had been corroded on a sectional surface by nital etchant so as to observe a structure thereof. The simple wear test is a test in which a sintered alloy machined into a shape of valve seat insert is press-fitted in an aluminum alloy housing, and the valve is caused to move in an up-and-down piston like motion by an eccentric cam rotated by a motor, such that the face of the valve and the face of the valve seat insert repeatedly impact each other. The temperature setting in this test was carried out by heating the bevel of the valve with a burner in order to simply simulate an environment inside the housing of an engine. In this test, the rotating speed of the eccentric cam was set at 2800 rpm, the test temperature was set at 300° C. at the valve seat portion, and the repetition period was set at 10 hours. The wear amounts on the valve seat inserts and the valves were measured and evaluated after the tests.

TABLE 3

| Sample No. | Area Ratio of Mo Silicide Particles % | Wear Amount μm VS | V | Total | Comments |
|---|---|---|---|---|---|
| G01 | 13.9 | 130 | 5 | 135 | Outside lower limit of Mo content in matrix forming powder |
| G02 | 14.0 | 107 | 5 | 112 | Within lower limit of Mo content in matrix forming powder |
| G03 | 13.9 | 90 | 5 | 95 | |
| G04 | 14.0 | 84 | 7 | 91 | |
| G05 | 14.1 | 82 | 7 | 89 | |
| G06 | 14.1 | 96 | 8 | 104 | Within upper limit of Mo content in matrix forming powder |
| G07 | 14.0 | 125 | 10 | 135 | Outside upper limit of Mo content in matrix forming powder |
| G08 | 13.9 | 132 | 5 | 137 | Outside lower limit of Mo content in 1st hard phase forming powder |
| G09 | 14.0 | 91 | 5 | 96 | Within lower limit of Mo content in 1st hard phase forming powder |
| G10 | 14.0 | 86 | 7 | 93 | |
| G11 | 14.0 | 91 | 10 | 101 | |
| G12 | 14.0 | 97 | 12 | 109 | Within upper limit of Mo content in 1st hard phase forming powder |
| G13 | 14.0 | 144 | 28 | 172 | Outside upper limit of Mo content in 1st hard phase forming powder |
| G14 | 13.9 | 115 | 5 | 120 | Outside lower limit of Si content in 1st hard phase forming powder |
| G15 | 14.0 | 95 | 5 | 100 | Within lower limit of Si content in 1st hard phase forming powder |
| G16 | 14.0 | 78 | 7 | 85 | |
| G17 | 14.1 | 78 | 7 | 85 | |
| G18 | 14.0 | 80 | 9 | 89 | |
| G19 | 14.0 | 96 | 12 | 108 | Within upper limit of Si content in 1st hard phase forming powder |
| G20 | 14.1 | 114 | 15 | 129 | Outside upper limit of Si content in 1st hard phase forming powder |
| G21 | 14.0 | 145 | 10 | 155 | |
| G22 | 14.0 | 122 | 5 | 127 | Outside lower limit of Cr content in 1st hard phase forming powder |
| G23 | 13.9 | 103 | 5 | 108 | Within lower limit of Cr content in 1st hard phase forming powder |
| G24 | 14.0 | 95 | 5 | 100 | |
| G25 | 14.0 | 87 | 5 | 92 | |
| G26 | 14.0 | 89 | 5 | 94 | |
| G27 | 14.0 | 91 | 7 | 98 | |
| G28 | 14.0 | 94 | 7 | 101 | Within upper limit of Cr content in 1st hard phase forming powder |
| G29 | 14.1 | 130 | 12 | 142 | Outside upper limit of Cr content in 1st hard phase forming powder |
| G30 | 14.0 | 125 | 5 | 130 | Outside lower limit of Ni content in 1st hard phase forming powder |
| G31 | 14.0 | 100 | 5 | 105 | Within lower limit of Ni content in 1st hard phase forming powder |
| G32 | 14.0 | 92 | 5 | 97 | |
| G33 | 14.0 | 90 | 5 | 95 | |
| G34 | 14.0 | 94 | 5 | 99 | |
| G35 | 14.0 | 96 | 7 | 103 | |
| G36 | 14.0 | 99 | 8 | 107 | Within upper limit of Ni content in 1st hard phase forming powder |
| G37 | 14.0 | 124 | 10 | 134 | Outside upper limit of Ni content in 1st hard phase forming powder |
| G38 | 14.1 | 94 | 11 | 105 | Within lower limit of Cr and Ni contents in 1st hard phase forming powder |
| G39 | 0.9 | 168 | 3 | 171 | Outside lower limit of addition amount of 1st hard phase forming powder |
| G40 | 3.0 | 112 | 3 | 115 | Within lower limit of addition amount of 1st hard phase forming powder |

TABLE 3-continued

| Sample No. | Area Ratio of Mo Silicide Particles % | Wear Amount μm VS | V | Total | Comments |
|---|---|---|---|---|---|
| G41 | 8.4 | 86 | 5 | 91 | |
| G42 | 19.6 | 86 | 10 | 96 | |
| G43 | 24.9 | 94 | 11 | 105 | |
| G44 | 30.0 | 100 | 12 | 112 | Within upper limit of addition amount of 1st hard phase forming powder |
| G45 | 34.9 | 147 | 25 | 172 | Outside upper limit of addition amount of 1st hard phase forming powder |
| G46 | 14.0 | 190 | 5 | 195 | Outside lower limit of addition amount of graphite powder |
| G47 | 14.0 | 110 | 5 | 115 | Within lower limit of addition amount of graphite powder |
| G48 | 14.0 | 93 | 7 | 100 | |
| G49 | 14.1 | 82 | 8 | 90 | |
| G50 | 14.0 | 102 | 10 | 112 | Within upper limit of addition amount of graphite powder |
| G51 | 14.0 | 116 | 12 | 128 | Outside upper limit of addition amount of graphite powder |
| G52 | — | 110 | 5 | 115 | Alloy disclosed in Japanese Patent Publication No. 5-55593 |

Figure 4:
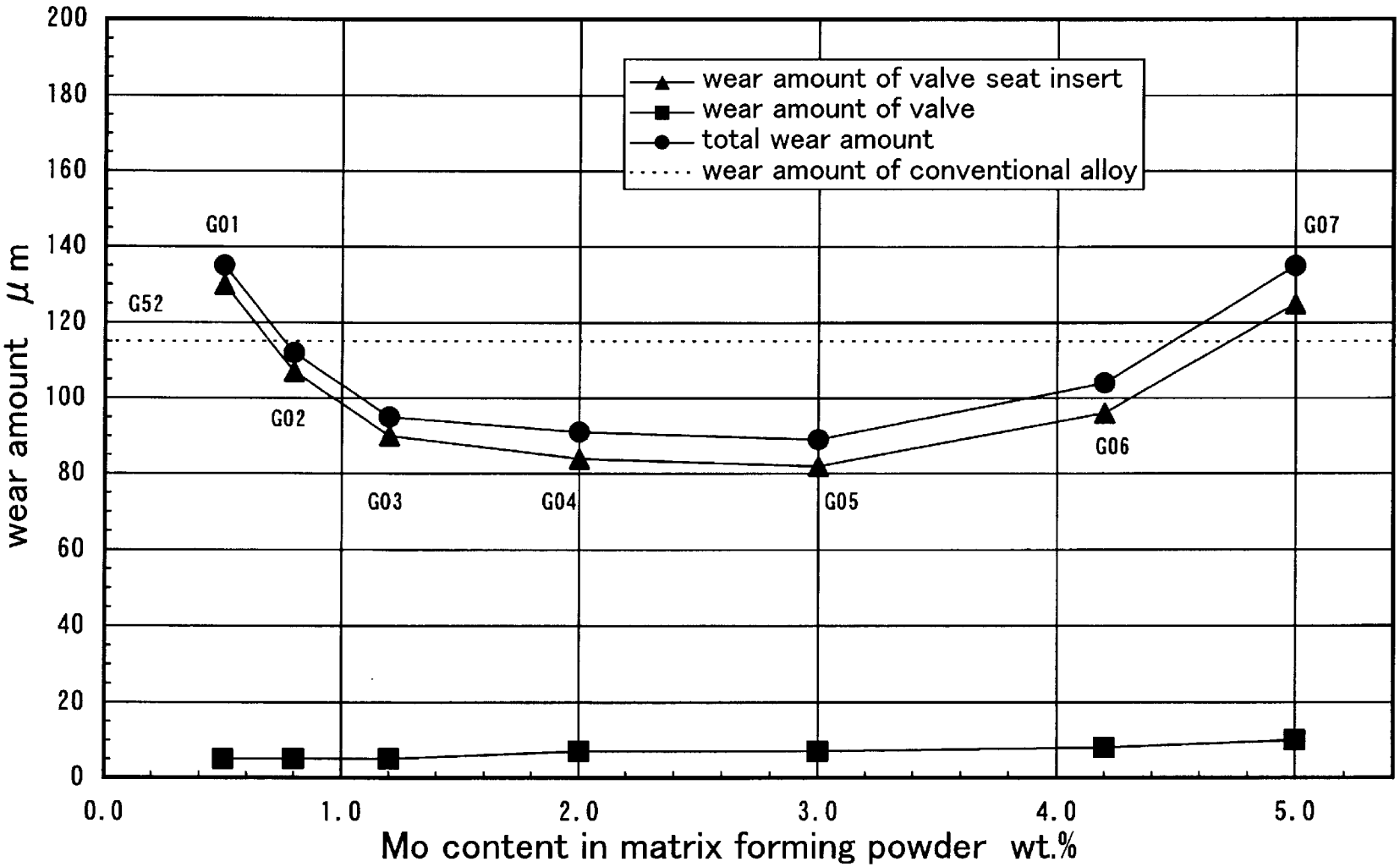
FIG. 4 is a graph showing the relationship between Mo content in the matrix forming powder and wear amount in the first Example according to the present invention.

Next, the above test results will be considered by referring to Table 3 and FIGS. 4 to 10, and the effect of the present invention will be made clear. FIG. 4 shows the effect of Mo content in the matrix forming powder by comparing samples numbers G01 to G07 in Table 3. As is clear from FIG. 4, the wear resistance was improved as the Mo content increased, and in particular, when the Mo content was 0.8% by mass or more, the wear resistance was improved to a higher level than that of conventional materials (sample number G52). In contrast, when the Mo content exceeded 4.2% by mass, the compressibility of the powder was reduced, and consequently, the strength was reduced and the wear resistance also decreased.

Figure 5:
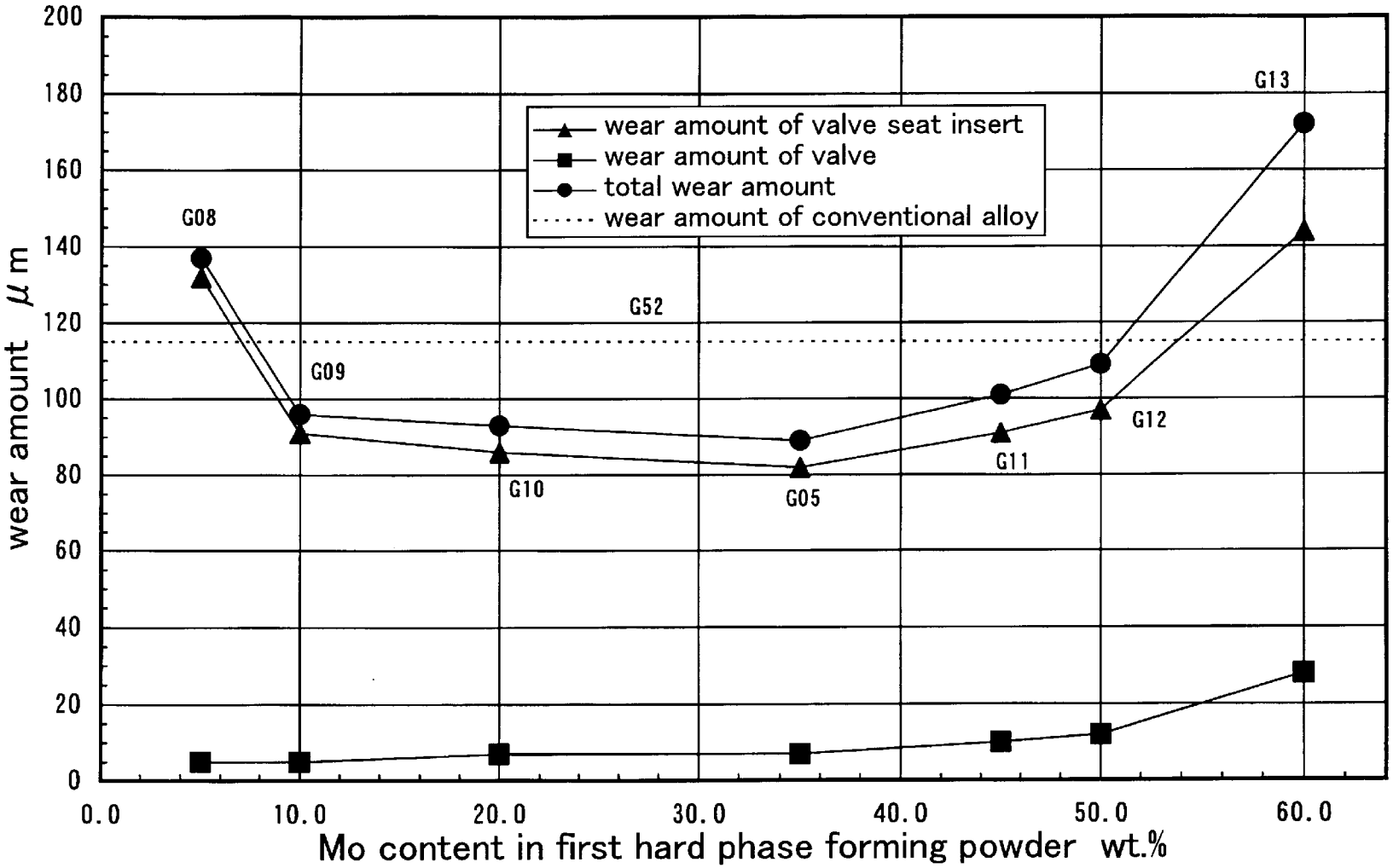
FIG. 5 is a graph showing the relationship between,Mo content in the first hard phase forming powder and wear amount in the first Example according to the present invention.

FIG. 5 shows the effect of Mo content in the first hard phase forming powder by comparing samples numbers G05 and G08 to G13 in Table 3. As is clear from FIG. 5, the wear resistance was improved as the Mo content increased, and in particular, when the Mo content was 10% by mass or more, the wear resistance was improved to a higher level than that of conventional materials (sample number G52). In contrast, when the Mo content exceeded 50% by mass, the hard phase was breakable by increasing the amount of Mo silicide which was formed, and therefore, part of the hard phase acted as a grinding powder by chipping during use, and the wear was increased.

Figure 6:
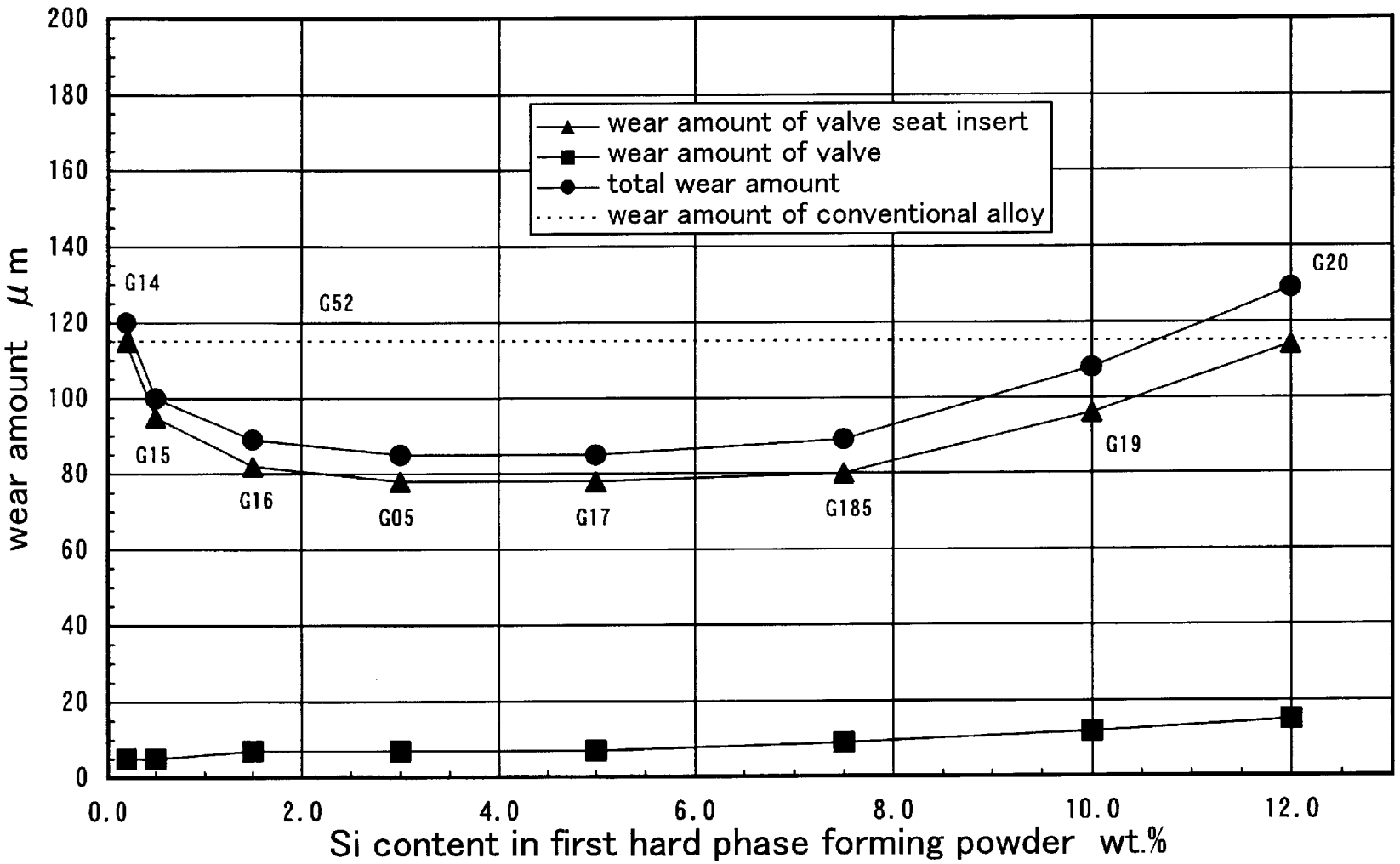
FIG. 6 is a graph showing the relationship between Si content in the first hard phase forming powder and wear amount in the first Example according to the present invention.

FIG. 6 shows the effect of the Si content in the first hard phase forming powder by comparing samples numbers G05 and G14 to G20 in Table 3. As is clear from FIG. 6, the wear resistance was improved as the Si content increased, and in particular, when the Si content was 0.5% by mass or more, the wear resistance was improved to a higher level than that of conventional materials (sample number G52). In contrast, when the Si content exceeded 10% by mass, the compressibility was reduced by hardening the powder, the adhesion to the matrix was deteriorated by firmly forming an oxide film on the powder surface, and the hard phase was breakable by increasing the amount of Mo silicide which was formed, and therefore, the wear amount was increased.

Figure 7:
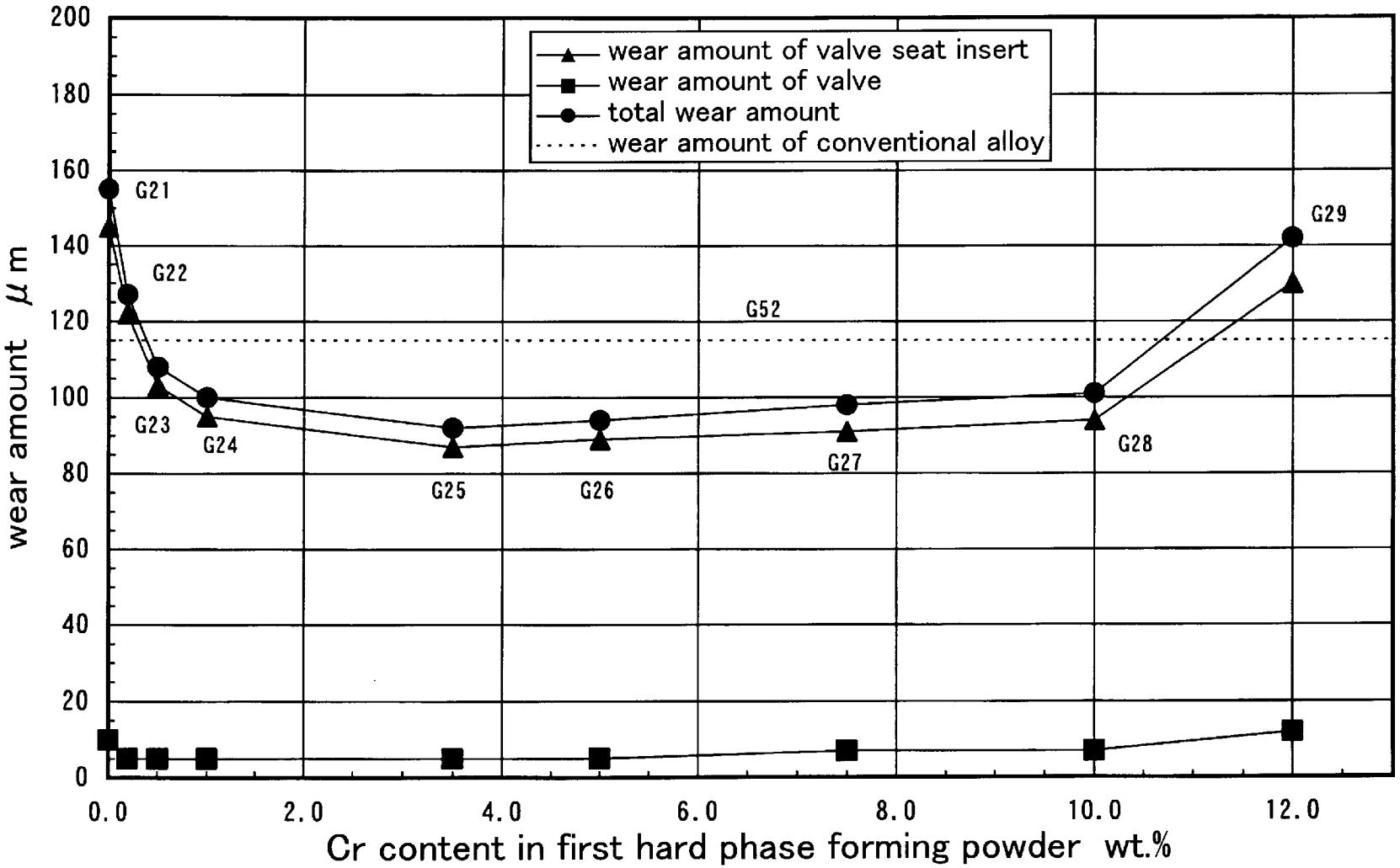
FIG. 7 is a graph showing the relationship between Cr content in the first hard phase forming powder and wear amount in the first Example according to the present invention.

FIG. 7 shows the effect of Cr content in the first hard phase forming powder by comparing samples numbers G21 to G29 in Table 3. As is clear from FIG. 7, the wear resistance was improved as the Cr content increased, and in particular, when the Cr content was 0.5% by mass or more, the wear resistance was improved to a higher level than that of conventional materials (sample number G52). In contrast, when the Cr content exceeded 10% by mass, the compressibility was reduced by hardening the powder, and the adhesion to the matrix was deteriorated by firmly forming an oxide film on the powder surface, and therefore, the wear amount was increased.

Figure 8:
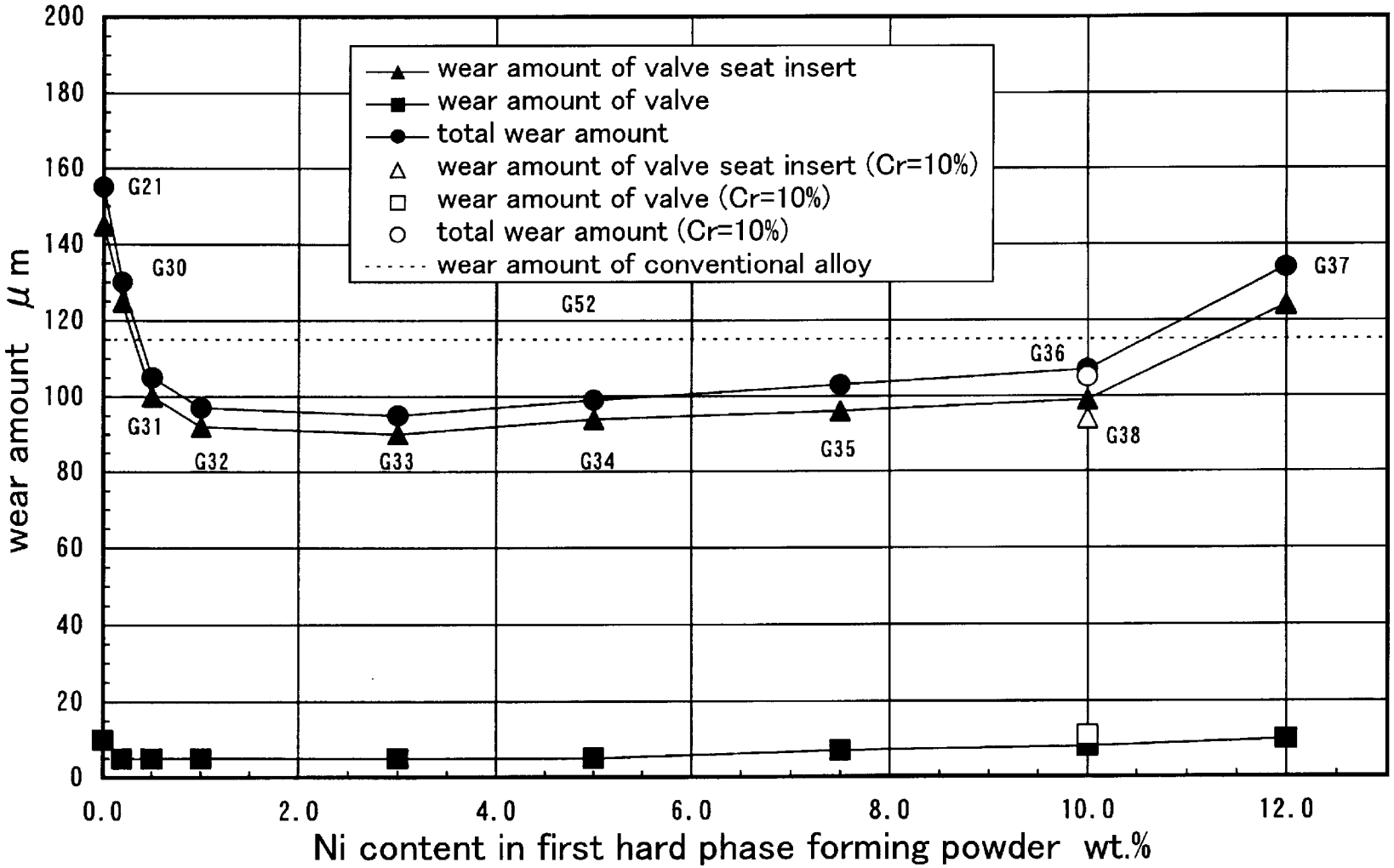
FIG. 8 is a graph showing the relationship between Ni content in the first hard phase forming powder and wear amount in the first Example according to the present invention.

FIG. 8 shows the effect of Ni content in the first hard phase forming powder by comparing samples numbers G21 and G30 to G37 in Table 3. As is clear from FIG. 8, the wear resistance was improved as the Ni content increased, and in particular, when the Ni content was 0.5% by mass or more, the wear resistance was improved to a higher level than that of conventional materials (sample number G52). In contrast, when the Ni content exceeded 10% by mass, the compressibility was reduced by hardening the powder, and the matrix was austenitized, and therefore, the wear amount was increased.

Figure 9:
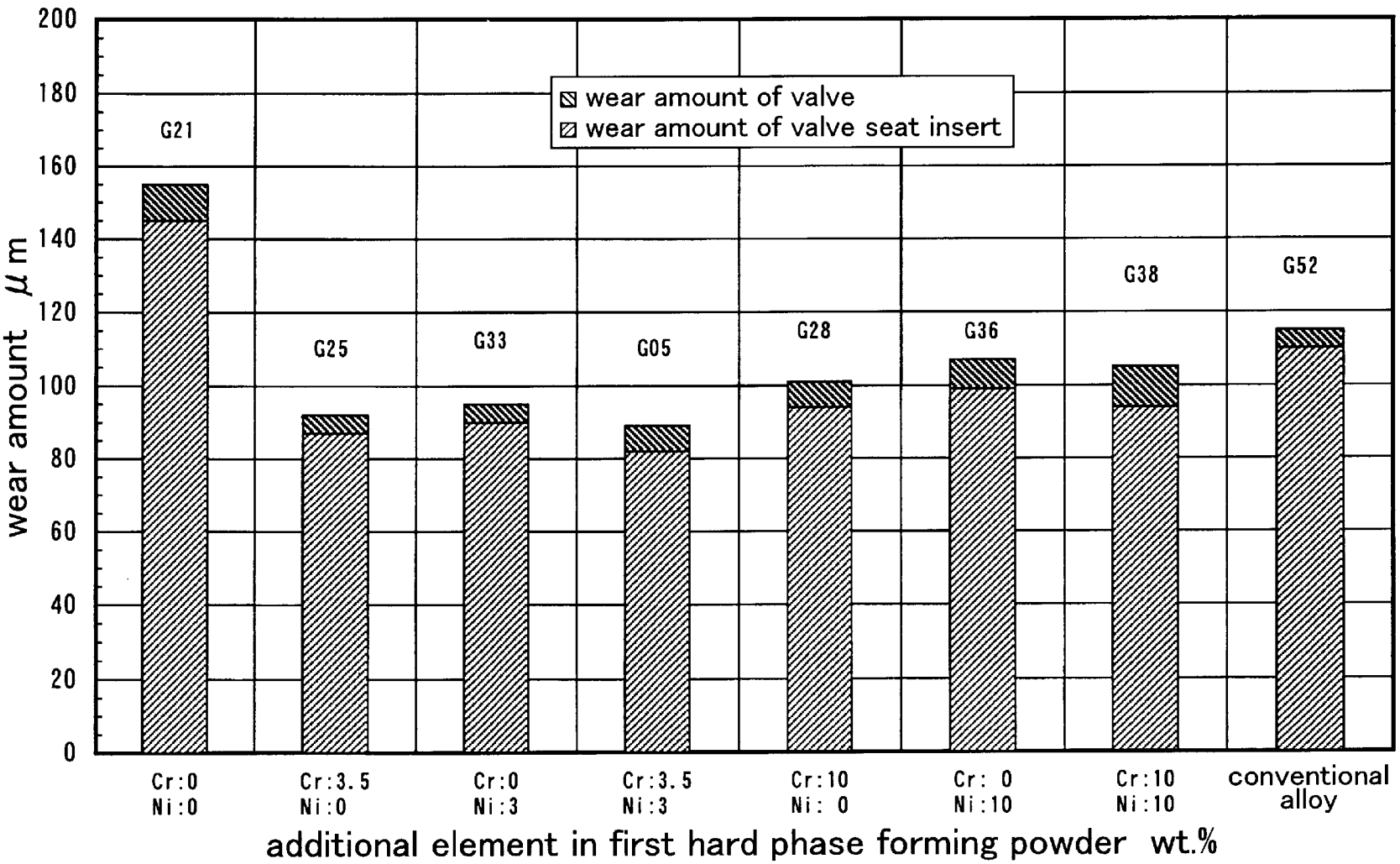
FIG. 9 is a graph showing the relationship between addition components in the first hard phase forming powder and wear amount in the first Example according to the present invention.

FIG. 9 shows the effect of Cr and Ni contents in the first hard phase forming powder by comparing samples numbers G05, G21, G25, G28, G33, G36, and G38 in Table 3. As is clear from FIG. 9, the wear resistances of samples numbers G25, G28, G33, and G36 which contained Cr or Ni in the first hard phase was more improved than those of sample number G21 which contain neither Cr nor Ni in the first hard phase, respectively, and the wear resistance of samples numbers G05 and G38 which contained Cr and Ni in the first hard phase, was further improved.

Figure 10:
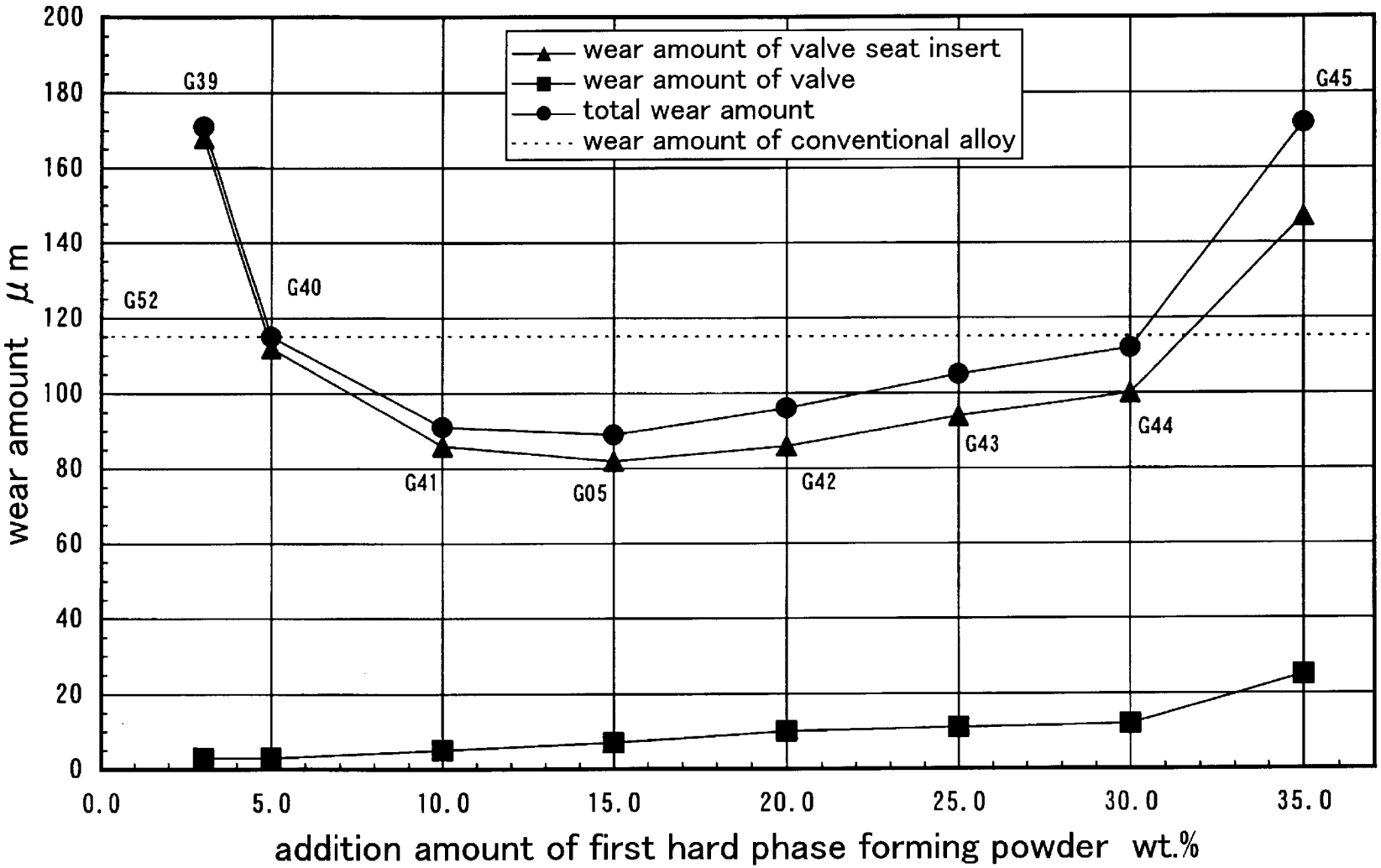
FIG. 10 is a graph showing the relationship between an addition amount of the first hard phase forming powder and wear amount in the first Example according to the present invention.

FIG. 10 shows the effect of an addition amount of the first hard phase forming powder by comparing samples numbers G05 and G39 to G45 in Table 3. As is clear from FIG. 10, the wear resistance was improved as the amount of the first hard phase forming powder increased, and in particular, when the addition amount of the first hard phase forming powder was 5.0% by mass or more, the wear resistance was improved to a higher level than that of conventional materials (sample number G52). In contrast, when the amount of the first hard phase forming powder which was added exceeded 30% by mass, a phase having a high hardness but low toughness was increased, and therefore, the wear amount was increased.

In addition, when an addition amount of the first hard phase forming powder was 5.0% by mass, an area ratio of Mo silicide particles in the first hard phase after sintering was 3%, and in contrast, when an addition amount of the first hard phase forming powder was 30% by mass, an area ratio of Mo silicide particles in the first hard phase after sintering was 30%, and therefore, when an area ratio of Mo silicide particles in the first hard phase after sintering was 3 to 30%, the wear resistance was preferably improved.

Figure 11:
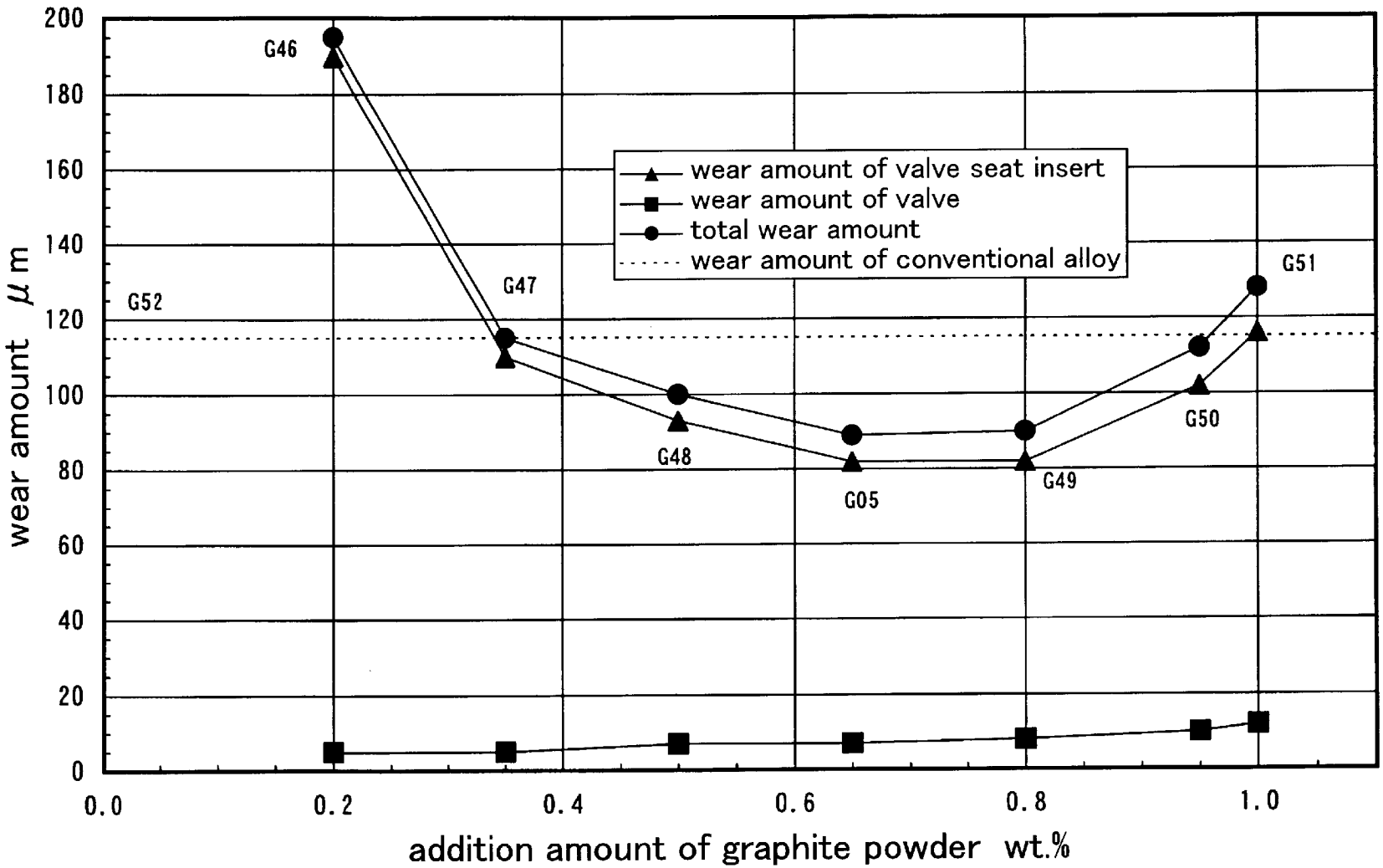
FIG. 11 is a graph showing the relationship between an addition amount of the graphite powder and wear amount in the first Example according to the present invention.

FIG. 11 shows the effect of an addition amount of graphite powder by comparing samples numbers G05 and G46 to G51 in Table 3. As is clear from FIG. 11, the wear resistance was improved as the amount of graphite powder added was increased, and in particular, when the amount of graphite powder which was added was 0.35% by mass or more, the wear resistance was improved to a higher level than that of conventional materials (sample number G52). In contrast, when the amount of graphite powder which was added exceeded 0.95% by mass, cementite was precipitated at grain boundaries, and therefore, the wear amount was increased.

Second Example

A matrix forming alloy powder consisting of a Mo content of 3% by mass and a balance of Fe and unavoidable impurities used in the first Example and first hard phase forming powders and second hard phase forming powders consisting of compositions shown in Table 4, were mixed with graphite powder at a compounding ratio shown in Table 4, to prepare a mixed powder, and the mixed powder was compacted and sintered under the same conditions as in the first Example, and therefore, samples numbers G53 to G69 consisting of overall compositions shown in Table 5 were produced. Then, area ratios of Mo silicide particles and Cr carbide particles were measured and simple wear tests were carried out, in the same manner as in the first Example. The results are shown in Table 6 and FIGS. 12 to 15.

TABLE 4

| Sample No. | Powder Mixing Ratio wt % | | | | | | | | | | | | | | | |
|---|---|---|---|---|---|---|---|---|---|---|---|---|---|---|---|---|
| | Matrix Forming Powder | First Hard Phase Forming Powder | | | | | | Second Hard Phase Forming Powder | | | | | | | Graphite Powder | Comments |
| | | | Composition wt % | | | | | | Composition wt % | | | | | | | |
| | | | Fe | Mo | Si | Cr | Ni | | Fe | Cr | C | Mo | V | W | | |
| G53 | Balance | 3.00 | Balance | 35.00 | 1.50 | | | 10.00 | Balance | 12.00 | 1.50 | | | | 0.65 | Outside lower limit of addition amount of 1st hard phase forming powder |
| G54 | Balance | 5.00 | Balance | 35.00 | 1.50 | | | 10.00 | Balance | 12.00 | 1.50 | | | | 0.65 | Within lower limit of addition amount of 1st hard phase forming powder |
| G55 | Balance | 8.00 | Balance | 35.00 | 1.50 | | | 10.00 | Balance | 12.00 | 1.50 | | | | 0.65 | |
| G56 | Balance | 15.00 | Balance | 35.00 | 1.50 | | | 10.00 | Balance | 12.00 | 1.50 | | | | 0.65 | |
| G57 | Balance | 25.00 | Balance | 35.00 | 1.50 | | | 10.00 | Balance | 12.00 | 1.50 | | | | 0.65 | Within upper limit of addition amount of 1st hard phase forming powder |
| G58 | Balance | 30.00 | Balance | 35.00 | 1.50 | | | 10.00 | Balance | 12.00 | 1.50 | | | | 0.65 | Outside upper limit of addition amount of 1st hard phase forming powder |
| G59 | Balance | 15.00 | Balance | 35.00 | 1.50 | 3.50 | 3.00 | 5.00 | Balance | 12.00 | 1.50 | | | | 0.65 | |
| G60 | Balance | 15.00 | Balance | 35.00 | 1.50 | 3.50 | 3.00 | 10.00 | Balance | 12.00 | 1.50 | | | | 0.65 | |
| G61 | Balance | 15.00 | Balance | 35.00 | 1.50 | 3.50 | 3.00 | 15.00 | Balance | 12.00 | 1.50 | | | | 0.65 | |
| G62 | Balance | 15.00 | Balance | 35.00 | 1.50 | 3.50 | 3.00 | 20.00 | Balance | 12.00 | 1.50 | | | | 0.65 | |
| G63 | Balance | 15.00 | Balance | 35.00 | 1.50 | 3.50 | 3.00 | 25.00 | Balance | 12.00 | 1.50 | | | | 0.65 | |
| G64 | Balance | 15.00 | Balance | 35.00 | 1.50 | 3.50 | 3.00 | 30.00 | Balance | 12.00 | 1.50 | | | | 0.65 | Within upper limit of addition amount of 2nd hard phase forming powder |
| G65 | Balance | 15.00 | Balance | 35.00 | 1.50 | 3.50 | 3.00 | 35.00 | Balance | 12.00 | 1.50 | | | | 0.65 | Outside upper limit of addition amount of 2nd hard phase forming powder |
| G66 | Balance | 15.00 | Balance | 35.00 | 1.50 | 3.50 | 3.00 | 10.00 | Balance | 12.00 | 1.50 | 1.50 | | | 0.65 | |
| G67 | Balance | 15.00 | Balance | 35.00 | 1.50 | 3.50 | 3.00 | 10.00 | Balance | 12.00 | 1.50 | | 1.50 | | 0.65 | |
| G68 | Balance | 15.00 | Balance | 35.00 | 1.50 | 3.50 | 3.00 | 10.00 | Balance | 12.00 | 1.50 | | | 3.00 | 0.65 | |
| G69 | Balance | 15.00 | Balance | 35.00 | 1.50 | 3.50 | 3.00 | 10.00 | Balance | 12.00 | 1.50 | 1.50 | 1.50 | 3.00 | 0.65 | |

TABLE 5

| Sample No. | Overall Composition wt % | | | | | | | | Comments |
|---|---|---|---|---|---|---|---|---|---|
| | Fe | Mo | Si | Cr | Ni | C | V | W | |
| G53 | Balance | 3.64 | 0.05 | 1.20 | 0.00 | 0.80 | | | Outside lower limit of addition amount of 1st hard phase forming powder |
| G54 | Balance | 4.28 | 0.08 | 1.20 | 0.00 | 0.80 | | | Within lower limit of addition amount of 1st hard phase forming powder |
| G55 | Balance | 5.24 | 0.12 | 1.20 | 0.00 | 0.80 | | | |
| G56 | Balance | 7.48 | 0.23 | 1.20 | 0.00 | 0.80 | | | |
| G57 | Balance | 10.68 | 0.38 | 1.20 | 0.00 | 0.80 | | | Within upper limit of addition amount of 1st hard phase forming powder |

TABLE 5-continued

| Sample No. | Overall Composition wt % Fe | Mo | Si | Cr | Ni | C | V | W | Comments |
|---|---|---|---|---|---|---|---|---|---|
| G58 | Balance | 12.28 | 0.45 | 1.20 | 0.00 | 0.80 | | | Outside upper limit of addition amount of 1st hard phase forming powder |
| G59 | Balance | 7.63 | 0.23 | 1.13 | 0.45 | 0.73 | | | |
| G60 | Balance | 7.48 | 0.23 | 1.73 | 0.45 | 0.80 | | | |
| G61 | Balance | 7.33 | 0.23 | 2.33 | 0.45 | 0.88 | | | |
| G62 | Balance | 7.18 | 0.23 | 2.93 | 0.45 | 0.95 | | | |
| G63 | Balance | 7.03 | 0.23 | 3.53 | 0.45 | 1.03 | | | |
| G64 | Balance | 6.88 | 0.23 | 4.13 | 0.45 | 1.10 | | | Within upper limit of addition amount of 2nd hard phase forming powder |
| G65 | Balance | 6.73 | 0.23 | 4.73 | 0.45 | 1.18 | | | Outside upper limit of addition amount of 2nd 1st hard phase forming powder |
| G66 | Balance | 7.63 | 0.23 | 1.73 | 0.45 | 0.80 | | | |
| G67 | Balance | 7.48 | 0.23 | 1.73 | 0.45 | 0.80 | 0.15 | | |
| G68 | Balance | 7.48 | 0.23 | 1.73 | 0.45 | 0.80 | | 0.30 | |
| G69 | Balance | 7.63 | 0.23 | 1.73 | 0.45 | 0.80 | 0.15 | 0.30 | |

Figure 12:
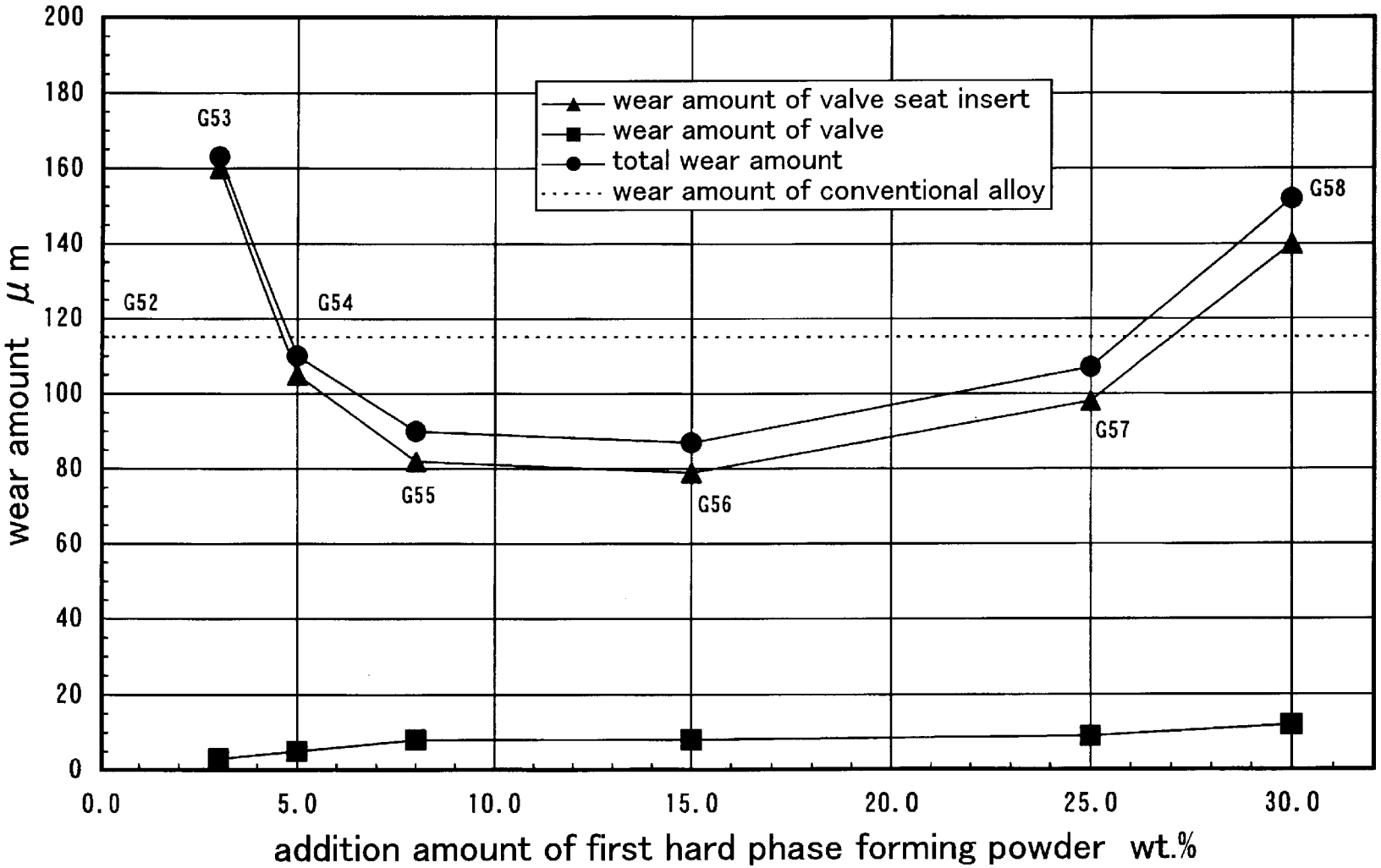
FIG. 12 is a graph showing the relationship between an addition amount of the first hard phase forming powder and wear amount in the second Example according to the present invention.

FIG. 12 shows the effect of an addition amount of the first hard phase forming powder when the amount of the second hard phase forming powder which was added was 10% by mass, by comparing samples numbers G53 to G58 in Table 6. As is clear from FIG. 12, the wear resistance was improved as the amount of the first hard phase forming powder was increased, and in particular, when the amount of the first hard phase forming powder which was added was 5.0% by mass or more, the wear resistance was improved to a higher level than that of conventional materials (sample number G52). In contrast, when the amount of the first hard phase forming powder which was added exceeded 25% by mass, a phase having a high hardness but low toughness was 5 increased, and therefore, the wear amount was increased.

TABLE 6

| Sample No. | Area Ratio of Mo Silicide Particles % | Area Ratio of Cr Carbide Particles % | Wear Amount μm VS | V | Total | Comments |
|---|---|---|---|---|---|---|
| G53 | 0.9 | 8.5 | 160 | 3 | 163 | Outside lower limit of addition amount of 1st hard phase forming powder |
| G54 | 3.0 | 8.4 | 105 | 5 | 110 | Within lower limit of addition amount of 1st hard phase forming powder |
| G55 | 6.8 | 8.5 | 82 | 8 | 90 | |
| G56 | 14.1 | 8.5 | 79 | 8 | 87 | |
| G57 | 24.9 | 8.4 | 98 | 9 | 107 | Within upper limit of addition amount of 1st hard phase forming powder |
| G58 | 29.9 | 8.5 | 140 | 12 | 152 | Outside upper limit of addition amount of 1st hard phase forming powder |
| G59 | 14.0 | 2.9 | 68 | 10 | 78 | |
| G60 | 14.0 | 8.4 | 52 | 10 | 62 | |
| G61 | 13.9 | 13.9 | 55 | 10 | 65 | |
| G62 | 13.9 | 19.5 | 60 | 12 | 72 | |
| G63 | 13.9 | 24.9 | 71 | 12 | 83 | |
| G64 | 14.0 | 30.0 | 90 | 14 | 104 | Within upper limit of addition amount of 2nd hard phase forming powder |
| G65 | 14.1 | 35.0 | 108 | 36 | 144 | Outside upper limit of addition amount of 2nd hard phase forming powder |
| G66 | 14.0 | 8.5 | 46 | 10 | 56 | |
| G67 | 14.1 | 8.4 | 47 | 10 | 57 | |
| G68 | 13.9 | 8.5 | 45 | 13 | 58 | |
| G69 | 14.0 | 8.6 | 40 | 16 | 56 | |

In addition, when the amount of the first hard phase forming powder which was added was 5.0% by mass, an area ratio of Mo silicide particles in the first hard phase after sintering was 3%, and in contrast, when the amount of the first hard phase forming powder which was added was 25% by mass, an area ratio of Mo silicide particles in the first hard phase after sintering was 25%, and therefore, when an area ratio of Mo silicide particles in the first hard phase after sintering was 3 to 25%, the wear resistance was preferably improved.

Figure 13:
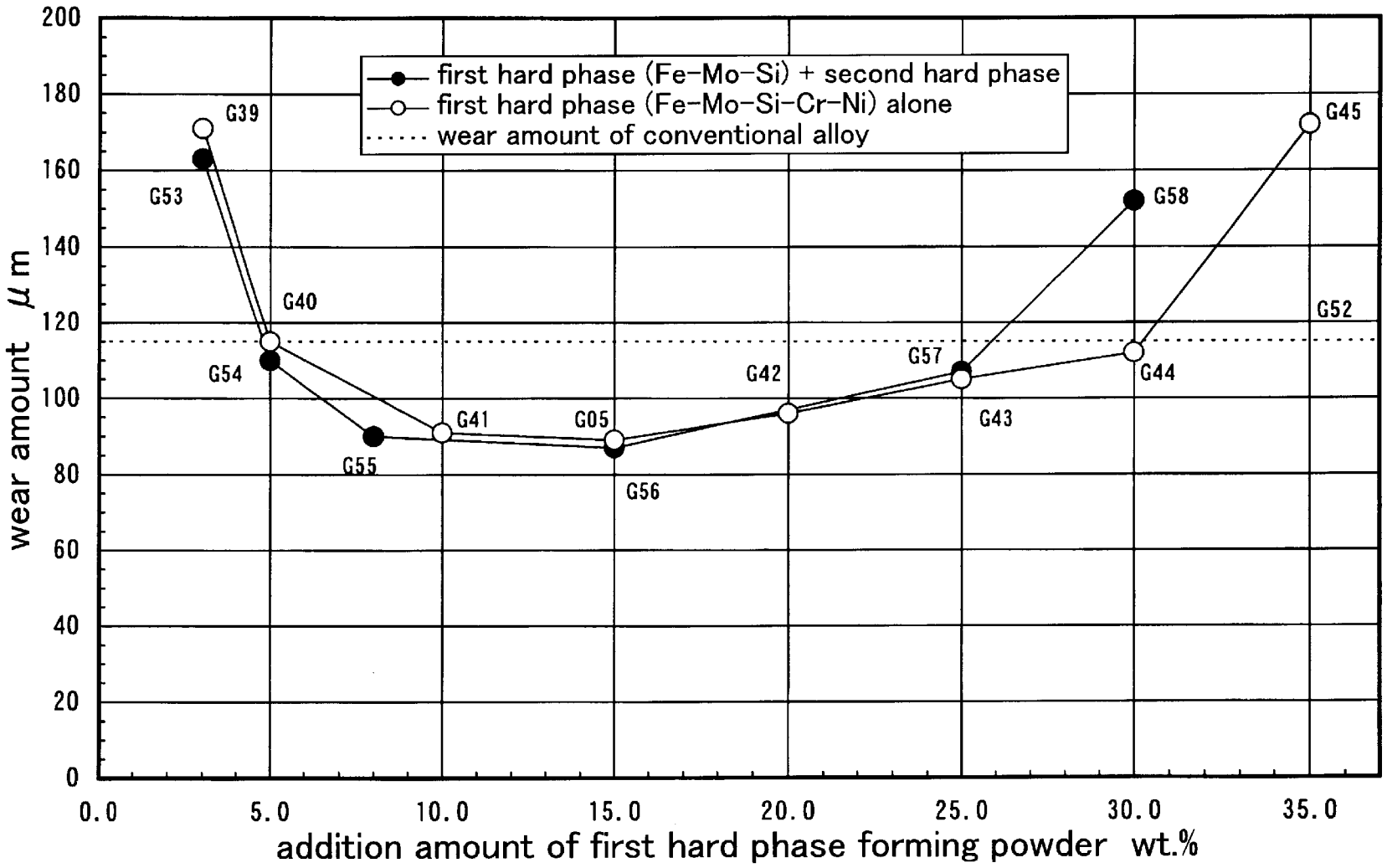
FIG. 13 is a graph showing the relationship between an addition amount of the first hard phase forming powder and wear amount in the second Example according to the present invention.

FIG. 13 shows a comparison of total wear amounts of samples numbers G05 and G39 to G45 of the first Example shown in FIG. 10 (cases of samples containing no second hard phase) with those of samples numbers G53 to G58 shown in FIG. 12 (cases of samples containing a second hard phase). As is clear from FIG. 13, the wear resistance was improved by diffusing the second hard phase in addition to the first hard phase. However, in this case, it was effective due to synergistic effect only when the amount of the first hard phase forming powder which was added was under 25% by mass. Furthermore, in FIGS. 7 to 9, in the case in which the second hard phase did not exist, when at least one of Cr and Ni was not contained in the first hard phase forming powder, the wear resistance was decreased. In contrast, in the case in which the second hard phase existed, the wear resistance was superior even if at least one of Cr and Ni was not contained in the first hard phase forming powder. This effect is supposed to be caused by the matrix in the first hard phase being strengthened by diffusing Cr contained in the second hard phase.

Figure 14:
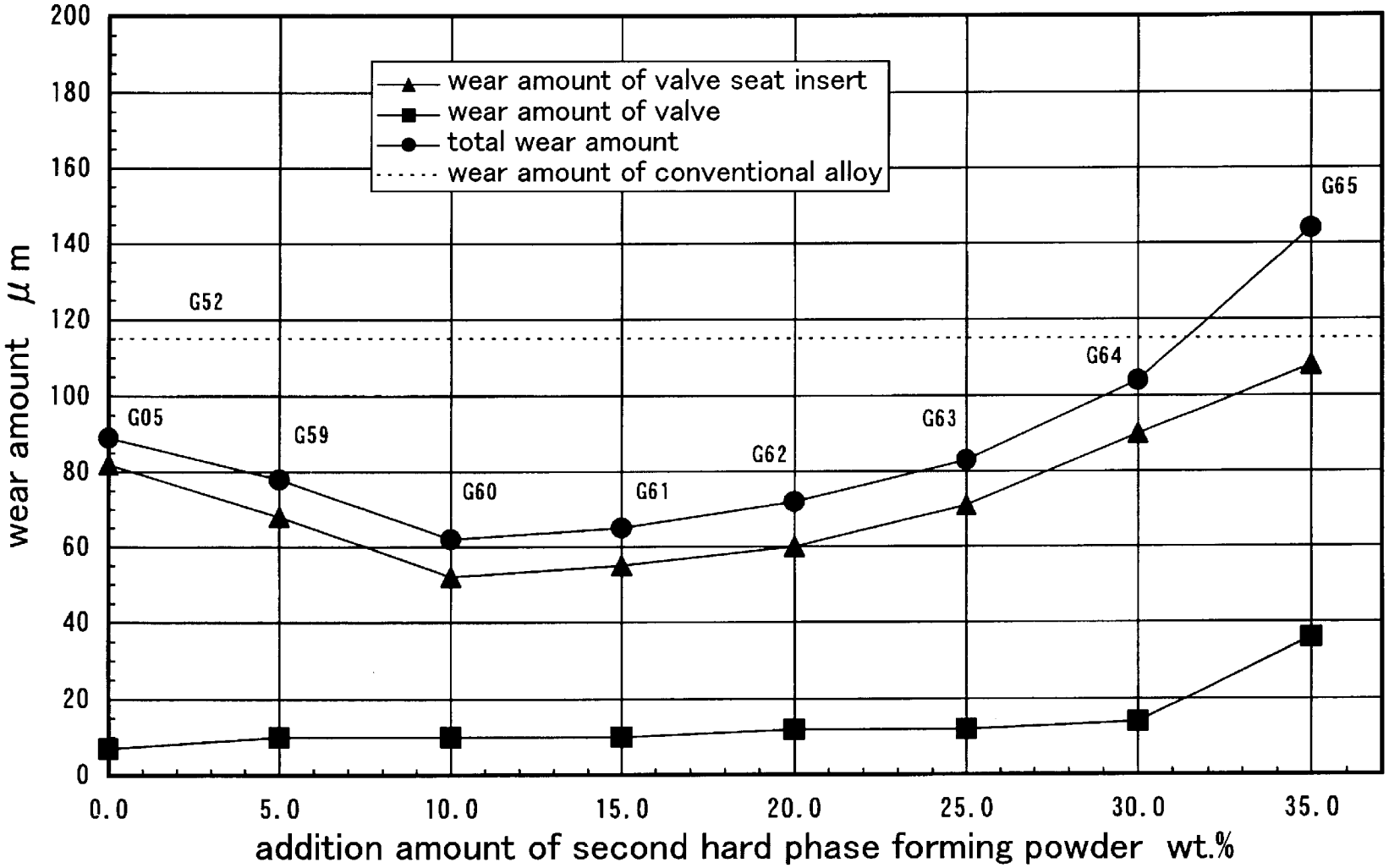
FIG. 14 is a graph showing the relationship between an addition amount of the second hard phase forming powder and wear amount in the second Example according to the present invention.

FIG. 14 shows the effect of the amount of addition of the second hard phase forming powder when the amount of the first hard phase forming powder which was added was 15% by mass, by comparing samples numbers G59 to G65 in Table 6. Herein, for comparison therewith, the results of sample number G05 in which the second hard phase forming powder was not added was also plotted. As is clear from FIG. 14, the wear resistance was substantially improved as the second hard phase forming powder added was increased in comparison with that of conventional materials (sample number G52). In contrast, when the amount of the second hard phase forming powder which was added exceeded 30% by mass, a ferrite phase having a low hardness and a higher Cr concentration than the matrix structure was increased, and therefore, the wear amount was increased.

Furthermore, when the amount of the second hard phase forming powder which was added was 5.0% by mass, an area ratio of Cr carbide particles in the second hard phase after sintering was 3%, and in contrast, when the amount of the second hard phase forming powder which was added was 30% by mass, an area ratio of Cr carbide particles in the second hard phase after sintering was 30%, and therefore, when an area ratio of Cr carbide particles in the second hard phase after sintering was 3 to 30%, the wear resistance was preferably improved.

Figure 15:
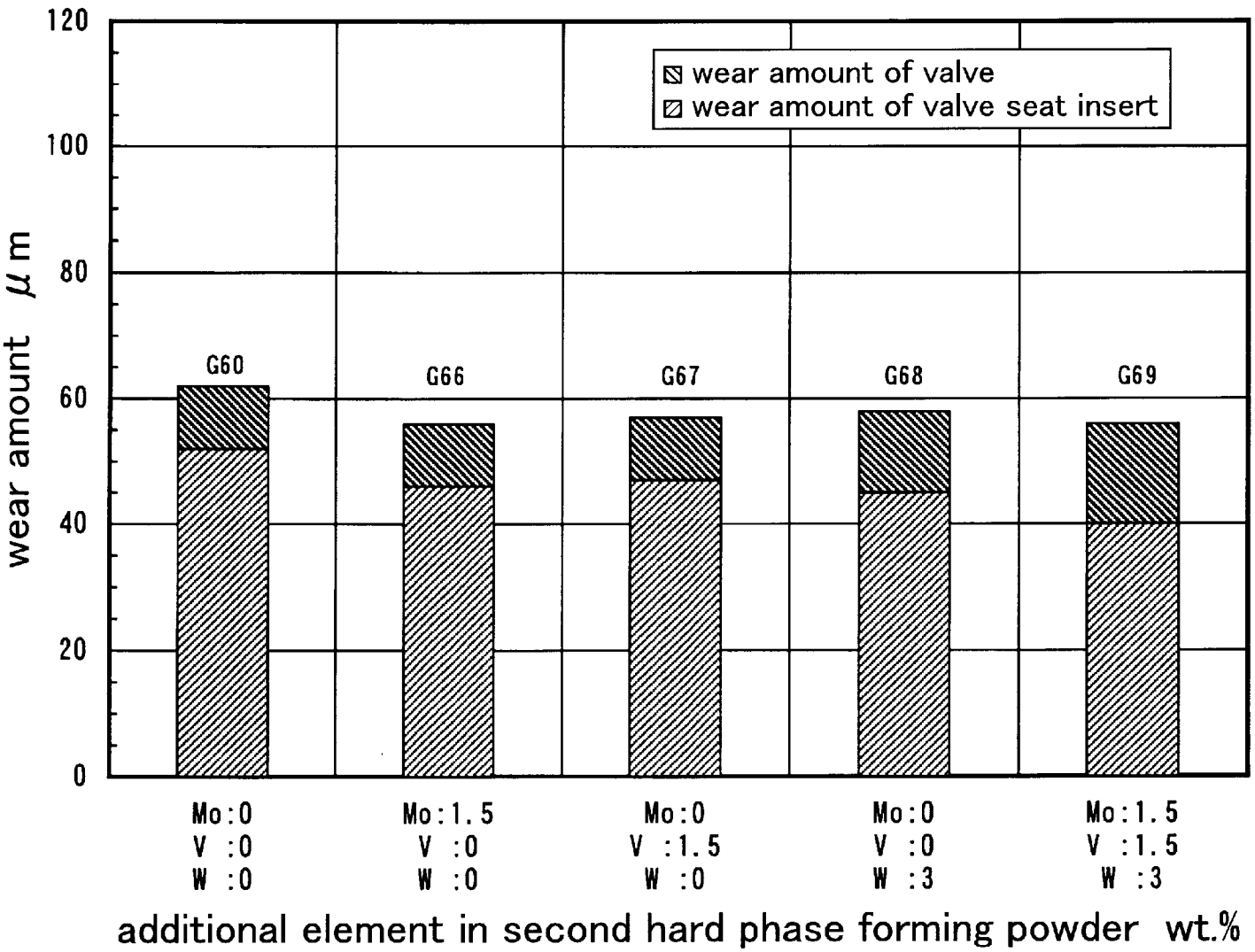
FIG. 15 is a graph showing the relationship between addition components in the second hard phase forming powder and wear amount in the second Example according to the present invention.

FIG. 15 shows the effect of the contents of Mo, V, and W in the second hard phase forming powder, by comparing samples numbers G60 and G66 to G69 in Table 6. As is clear from FIG. 15, the wear resistance was more improved than that of a sample not containing them (sample number G60) by containing at least one of Mo, V, and W in the second hard phase forming powder.

Third Example

An Fe—Mo alloy powder having a Mo content of 3% by mass and a balance of Fe and unavoidable impurities used in the first and second Example as a matrix forming alloy powder and an Fe—Cr-based alloy powder consisting of, by mass, Cr: 3%, Mo: 0.3%, V: 0.3%, and a balance of Fe and unavoidable impurities, were prepared. Then, a first hard phase forming powder consisting of, by mass, Mo: 35%, Si: 1.5%, and a balance of Fe and unavoidable impurities, a second hard phase forming powder consisting of, by mass, Cr: 12%, C: 1.5%, and a balance of Fe and unavoidable impurities, and graphite powder, used in the second Example, were prepared. These powders were mixed at a compounding ratio shown in Table 7 to prepare a mixed powder, and the mixed powder was compacted and sintered under the same conditions as in the first Example, and therefore, samples numbers G70 to G75 consisting of overall compositions shown in Table 8 were produced. Then, simple wear tests were carried out in the same manner as in the first Example. The results are shown in Table 9 and FIG. 16.

TABLE 7

| | Powder Mixing Ratio wt % | | | | | |
|---|---|---|---|---|---|---|
| | Matrix Forming Powder | | First Hard | Second Hard | | |
| Sample No. | Fe—Mo Alloy Powder | Fe—Cr Alloy Powder | Phase Forming Powder | Phase Forming Powder | Graphite Powder | Comments |
| G70 | Balance | 1.00 | 15.00 | 10.00 | 0.65 | |
| G71 | Balance | 5.00 | 15.00 | 10.00 | 0.65 | |
| G72 | Balance | 20.00 | 15.00 | 10.00 | 0.65 | |
| G73 | Balance | 40.00 | 15.00 | 10.00 | 0.65 | |
| G74 | Balance | 60.00 | 15.00 | 10.00 | 0.65 | |
| G75 | Balance | 70.00 | 15.00 | 10.00 | 0.65 | Outside addition amount of Fe—Cr-based alloy |

TABLE 8

| Sample | Overall Composition wt % | | | | | | |
|---|---|---|---|---|---|---|---|
| No. | Fe | Mo | Si | Cr | C | V | Comments |
| G70 | Balance | 7.45 | 0.23 | 1.23 | 0.80 | 0.0030 | |
| G71 | Balance | 7.35 | 0.23 | 1.35 | 0.80 | 0.02 | |
| G72 | Balance | 6.94 | 0.23 | 1.80 | 0.80 | 0.06 | |
| G73 | Balance | 6.40 | 0.23 | 2.40 | 0.80 | 0.12 | |
| G74 | Balance | 5.86 | 0.23 | 3.00 | 0.80 | 0.18 | |
| 675 | Balance | 5.59 | 0.23 | 3.30 | 0.80 | 0.21 | Outside addition amount of Fe—Cr-based alloy |

TABLE 9

| Sample No. | Area Ratio of Mo Silicide Particles % | Area Ratio of Cr Carbide Particles % | Wear Amount μm VS | V | Total | Comments |
|---|---|---|---|---|---|---|
| G70 | 14.0 | 8.5 | 77 | 8 | 85 | |
| G71 | 14.0 | 8.5 | 76 | 7 | 83 | |
| G72 | 14.1 | 8.4 | 69 | 7 | 76 | |
| G73 | 14.1 | 8.4 | 70 | 8 | 78 | |
| G74 | 14.0 | 8.5 | 79 | 9 | 88 | |
| G75 | 14.0 | 8.4 | 105 | 11 | 116 | Outside addition amount of Fe—Cr-based alloy |

Figure 16:
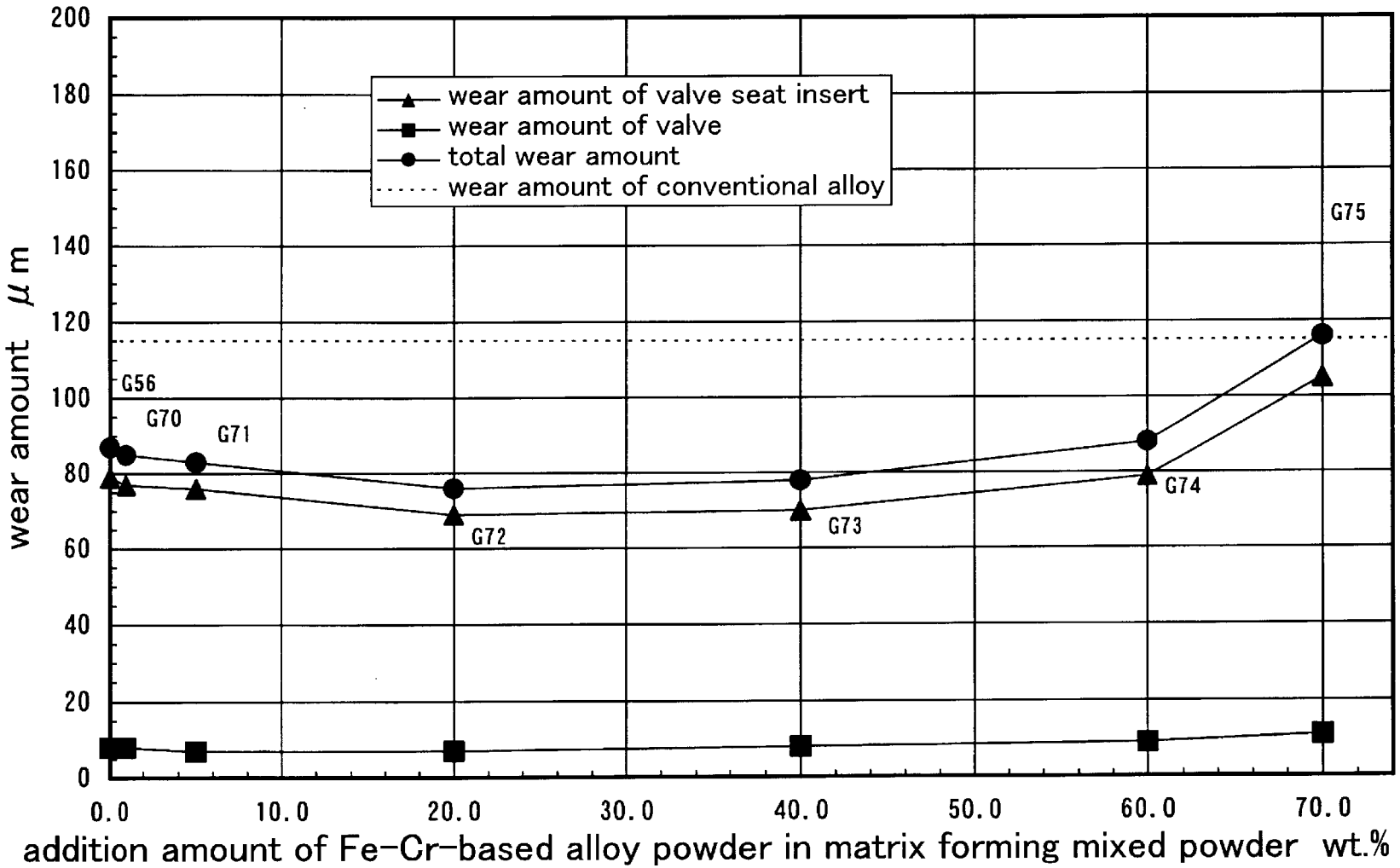
FIG. 16 is a graph showing the relationship between an addition amount of the Fe—Cr-based alloy powder in the matrix forming mixed powder and wear amount in the third Example according to the present invention.

FIG. 16 shows the effect of the amount of the Fe—Cr-based alloy powder in the case in which the Fe—Cr-based alloy powder was added to the Fe—Mo alloy powder as a matrix, and for comparison therewith, the result of sample number G56 of the second Example, which did not use the Fe—Cr-based alloy powder, was also plotted. As is clear from FIG. 16, when the addition amount was 60% by mass or less, the wear resistance was improved by adding the Fe—Cr-based alloy powder to the matrix. However, when the addition amount exceeded 60% by mass, the wear amount was of the same level as that of conventional materials, and therefore, it is preferable that the amount of the Fe—Cr-based alloy powder which is added be 60% or less in order to improve the wear resistance.

Fourth Example

An Fe—Co-based alloy powder consisting of, by mass, Co: 6.5%, Mo: 1.5%, Ni: 1.5%, and a balance of Fe and unavoidable impurities, an Fe—Ni-based alloy powder consisting of, by mass, Ni: 4%, Cu: 1.5%, Mo: 0.5%, and a balance of Fe and unavoidable impurities, in which each element was partially dispersed and combined with a pure Fe powder, and an Fe—Ni-based mixed powder which was a mixture of Ni of 10% by mass with an Fe powder, were prepared. Then, a first hard phase forming powder consisting of, by mass, Mo: 35%, Si: 1.5%, and a balance of Fe and unavoidable impurities, a second hard phase forming powder consisting of, by mass, Cr: 12%, C: 1.5%, and a balance of Fe and unavoidable impurities, and graphite powder, used in the second Example, were prepared. These powders were mixed at a compounding ratio shown in Table 10 to prepare a mixed powder, and the mixed powder was compacted and sintered in the same condition as in the first Example, and therefore, samples numbers G76 to G78 consisting of the overall compositions shown in Table 11 were produced. Then, simple wear tests were carried out, in the same manner as in the first Example. The results are shown in Table 11 and FIG. 17.

TABLE 10

| Sample No. | Powder Mixing Ratio wt % — Matrix Forming Powder Species | Matrix Forming Powder Additional Amount wt % | First Hard Phase Forming Powder Species | First Hard Phase Forming Powder Additional Amount wt % | Second Hard Phase Forming Powder Species | Second Hard Phase Forming Powder Additional Amount wt % | Graphite Powder Additional Amount wt % |
|---|---|---|---|---|---|---|---|
| G76 | Fe-6.5Co-1.5Mo-1.5Ni Alloy Powder | Balance | Fe-35Mo-1.5Si Alloy Powder | 15 | Fe-12Cr-1.5C Alloy Powder | 10 | 0.65 |
| G77 | Fe-4Ni-1.5Cu-0.5Mo Partially Diffusing Alloy Powder | Balance | Fe-35Mo-1.5Si Alloy Powder | 15 | Fe-12Cr-1.5C Alloy Powder | 10 | 0.65 |
| G78 | Fe Powder<br>Ni Powder | Balance<br>10 | Fe-35Mo-1.5Si Alloy Powder | 15 | Fe-12Cr-1.5C Alloy Powder | 10 | 0.65 |
| G52 | Fe-6.5Co-1.5Mo-1.5Ni Alloy Powder | Balance | Co-28Mo-8Cr-2.5Si Alloy Powder | | | 15 | 1.00 |

TABLE 11

| Sample No. | Overall Composition wt % Fe | Mo | Cr | Si | Co | Ni | Cu | V | C | Wear Amount μm VS | V | Total |
|---|---|---|---|---|---|---|---|---|---|---|---|---|
| G76 | Balance | 4.22 | 1.80 | 0.50 | 5.28 | 1.22 | | | 1.03 | 87 | 7 | 94 |
| G77 | Balance | 3.41 | 1.80 | 0.50 | | 3.25 | 1.22 | | 1.03 | 88 | 9 | 97 |
| G78 | Balance | 3.00 | 1.80 | 0.05 | | 10.00 | | | 1.23 | 97 | 6 | 103 |
| G52 | Balance | 5.46 | 1.20 | 0.38 | 14.69 | 1.26 | | | 1.00 | 110 | 5 | 115 |

Figure 17:
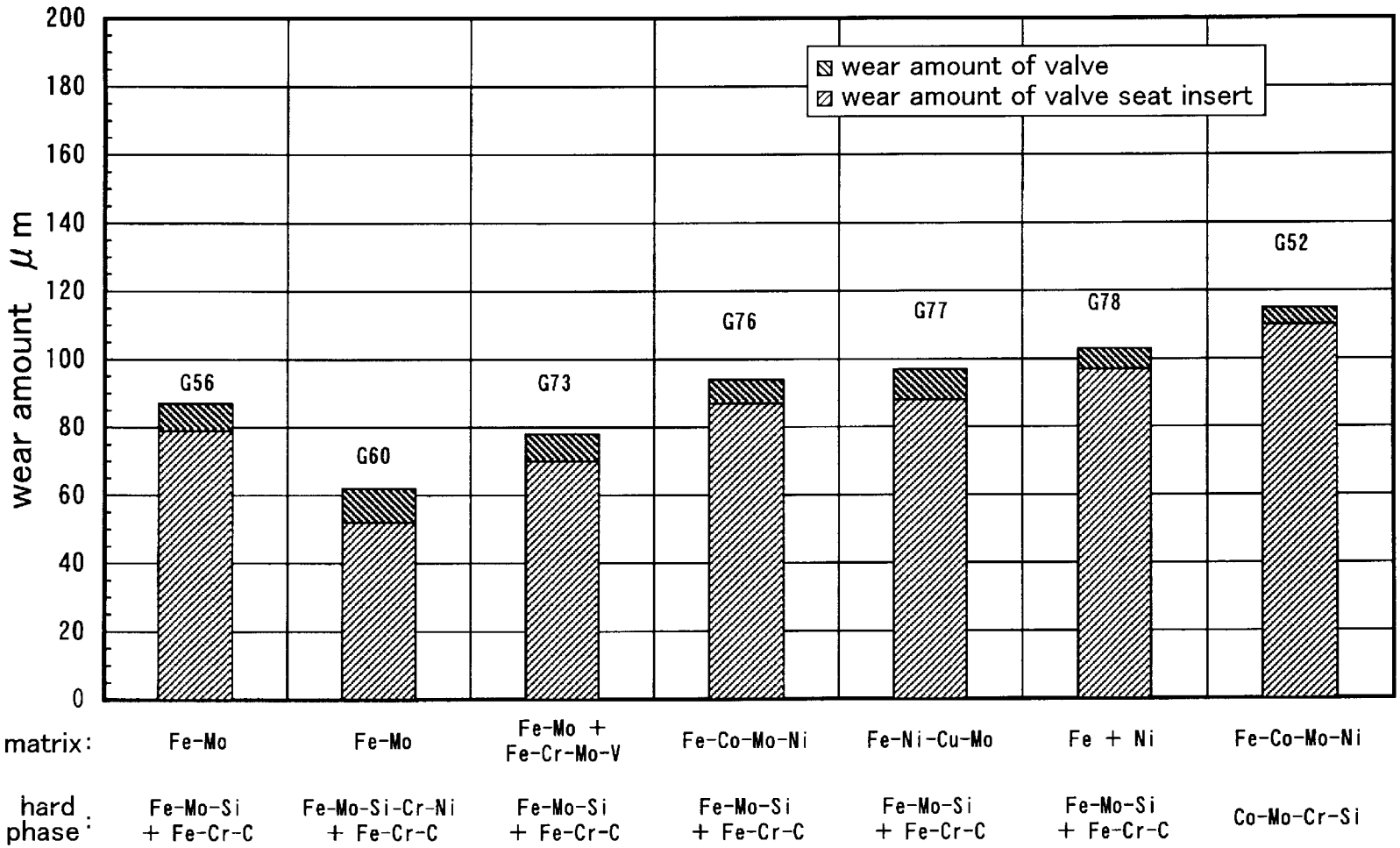
FIG. 17 is a graph showing the relationship between species of the matrix and the first or second hard phases and wear amount in the fourth Example according to the present invention.

FIG. 17 shows the wear resistance in the case in which the Fe—Co-based alloy powder or the Fe—Ni-based alloy powder, which were conventional materials, were used as a matrix, and for comparison therewith, the results of sample number G56 of the second Example in which the matrix consisted of an Fe—Mo-based alloy and in which Cr or Ni was not contained in the first hard phase, sample number G60 of the second Example in which the matrix consisted of an Fe—Mo-based alloy and in which Cr and Ni were contained in the first hard phase, sample number G73 of the third Example in which the matrix consisted of an Fe—Mo-based alloy and an Fe—Co-based, and sample number G52 of the first Example in which a Co-based hard phase was diffused in an Fe—Co-based matrix, as a conventional material, were also plotted. As is clear from FIG. 17, the sample comprising the first hard phase and the second hard phase according to the present invention exhibited superior wear resistance to the conventional alloy, and improved the wear resistance without using an expensive Co-based matrix alloy phase.

Fifth Example

A machinability improving material powder was further mixed with the mixed powder of sample number G60 produced in the second Example, in the same condition as in the first Example, and the mixed powder was compacted and sintered in the same condition as in the first Example, and therefore, samples numbers G79 to G85 were produced. Species and compounding ratios of matrix forming powders (Fe-3Mo alloy powders), first hard phase forming powders (Fe-35Mo-1.5Si-3.5Cr-3Ni alloy powders), second hard phase forming powders (Fe-12Cr-1.5C alloy powders), graphite powder, and various machinability improving components, in the third embodiment, are shown in Table 12, and overall compositions the sintered alloy samples are shown in Table 13. In addition, acrylic resin or lead was filled in pores of the sintered alloy of samples numbers G74 and G75. The simple wear tests were carried out under the same condition on the sintered alloy samples as in the first practical example. With respect to these sintered alloy samples, simple wear tests were carried out, in the same manner as in the first Example. The results are shown in Table 11 and FIG. 17. Furthermore, in the fifth Example, machinability tests were also carried out. The machinability test is a test in which a sample is drilled with a prescribed load using a bench drill and the number of the successful machining processes are compared. In the present test, the load was set to 1.3 kg, and the drill used was a cemented carbide drill having a diameter of 3 mm. The thickness of the sample was set to 5 mm. The results are shown in Table 14 and FIGS. 18 and 19.

TABLE 12

| Sample No. | Powder Mixing Ratio wt % Matrix Forming Powder | First Hard Phase Forming Powder | Second Hard Phase Forming Powder | Graphite Powder | Machinability Improving Powder Species | | Infiltration/ Impregnation | Comments |
|---|---|---|---|---|---|---|---|---|
| G79 | Balance | 15.00 | 10.00 | 0.65 | $MoS_2$ Powder | 0.30 | | |
| G80 | Balance | 15.00 | 10.00 | 0.65 | $MoS_2$ Powder | 0.60 | | |
| G81 | Balance | 15.00 | 10.00 | 0.65 | $MoS_2$ Powder | 0.80 | | |
| G82 | Balance | 15.00 | 10.00 | 0.65 | $MoS_2$ Powder | 1.00 | | |
| G83 | Balance | 15.00 | 10.00 | 0.65 | $MoS_2$ Powder | 1.50 | | |
| G84 | Balance | 15.00 | 10.00 | 0.65 | $MoS_2$ Powder | 2.00 | | Within addition amount of macinability improving component |
| G85 | Balance | 15.00 | 10.00 | 0.65 | $MoS_2$ Powder | 2.50 | | Outside addition amount of macinability improving component |
| G86 | Balance | 15.00 | 10.00 | 0.65 | Mn Powder | 1.00 | | |
| G87 | Balance | 15.00 | 10.00 | 0.65 | BN Powder | 1.00 | | |
| G88 | Balance | 15.00 | 10.00 | 0.65 | Pb Powder | 1.00 | | |
| G89 | Balance | 15.00 | 10.00 | 0.65 | CaF Powder | 1.00 | | |
| G90 | Balance | 15.00 | 10.00 | 0.65 | $MgSiO_4$ Powder | 1.00 | | |
| G91 | Balance | 15.00 | 10.00 | 0.65 | | | Acrylic Resin | |
| G92 | Balance | 15.00 | 10.00 | 0.65 | | | Pb | |

TABLE 13

| Sample No. | Overall Composition wt % Fe | Mo | Si | Cr | Ni | C | Machinability Improving Material Species | | Comments |
|---|---|---|---|---|---|---|---|---|---|
| G79 | Balance | 7.92 | 0.23 | 1.73 | 0.45 | 0.80 | $MoS_2$ | 0.30 | |
| G80 | Balance | 7.91 | 0.23 | 1.73 | 0.45 | 0.80 | $MoS_2$ | 0.60 | |
| G81 | Balance | 7.91 | 0.23 | 1.73 | 0.45 | 0.80 | $MoS_2$ | 0.80 | |
| G82 | Balance | 7.00 | 0.23 | 1.73 | 0.45 | 0.80 | $MoS_2$ | 1.00 | |
| G83 | Balance | 7.89 | 0.23 | 1.73 | 0.45 | 0.80 | $MoS_2$ | 1.50 | |
| G84 | Balance | 7.87 | 0.23 | 1.73 | 0.45 | 0.80 | $MoS_2$ | 2.00 | Within addition amount of macinability improving component |
| G85 | Balance | 7.86 | 0.23 | 1.73 | 0.45 | 0.80 | $MoS_2$ | 2.50 | Outside addition amount of macinability improving component |
| G86 | Balance | 7.90 | 0.23 | 1.73 | 0.45 | 0.80 | MnS | 1.00 | |
| G87 | Balance | 7.90 | 0.23 | 1.73 | 0.45 | 0.80 | BN | 1.00 | |
| G88 | Balance | 7.90 | 0.23 | 1.73 | 0.45 | 0.80 | Pb | 1.00 | |

TABLE 13-continued

| Sample | Overall Composition wt % | | | | | | Machinability Improving Material | | |
|---|---|---|---|---|---|---|---|---|---|
| No. | Fe | Mo | Si | Cr | Ni | C | Species | | Comments |
| G89 | Balance | 7.90 | 0.23 | 1.73 | 0.45 | 0.80 | CaF | 1.00 | |
| G90 | Balance | 7.90 | 0.23 | 1.73 | 0.45 | 0.80 | $MgSiO_4$ | 1.00 | |
| G91 | Balance | 7.93 | 0.23 | 1.73 | 0.45 | 0.80 | Acrylic Resin | Impregnation | |
| G92 | Balance | 7.93 | 0.23 | 1.73 | 0.45 | 0.80 | Pb | Infiltration | |

TABLE 14

| Sample | Wear Amount μm | | | Number of | |
|---|---|---|---|---|---|
| No. | VS | V | Total | Processed Pores | Comments |
| G79 | 50 | 8 | 58 | 13 | |
| G80 | 46 | 7 | 53 | 15 | |
| G81 | 44 | 6 | 50 | 16 | |
| G82 | 42 | 6 | 48 | 17 | |
| G83 | 43 | 7 | 50 | 19 | |
| G84 | 54 | 10 | 64 | 21 | Within addition amount of macinability improving component |
| G85 | 103 | 26 | 129 | 22 | Outside addition amount of macinability improving component |
| G86 | 46 | 8 | 54 | 18 | |
| G87 | 51 | 10 | 61 | 16 | |
| G88 | 41 | 4 | 45 | 22 | |
| G89 | 51 | 8 | 59 | 17 | |
| G90 | 49 | 8 | 57 | 19 | |
| G91 | 52 | 10 | 62 | 26 | |
| G92 | 38 | 4 | 42 | 41 | |

Figure 18:
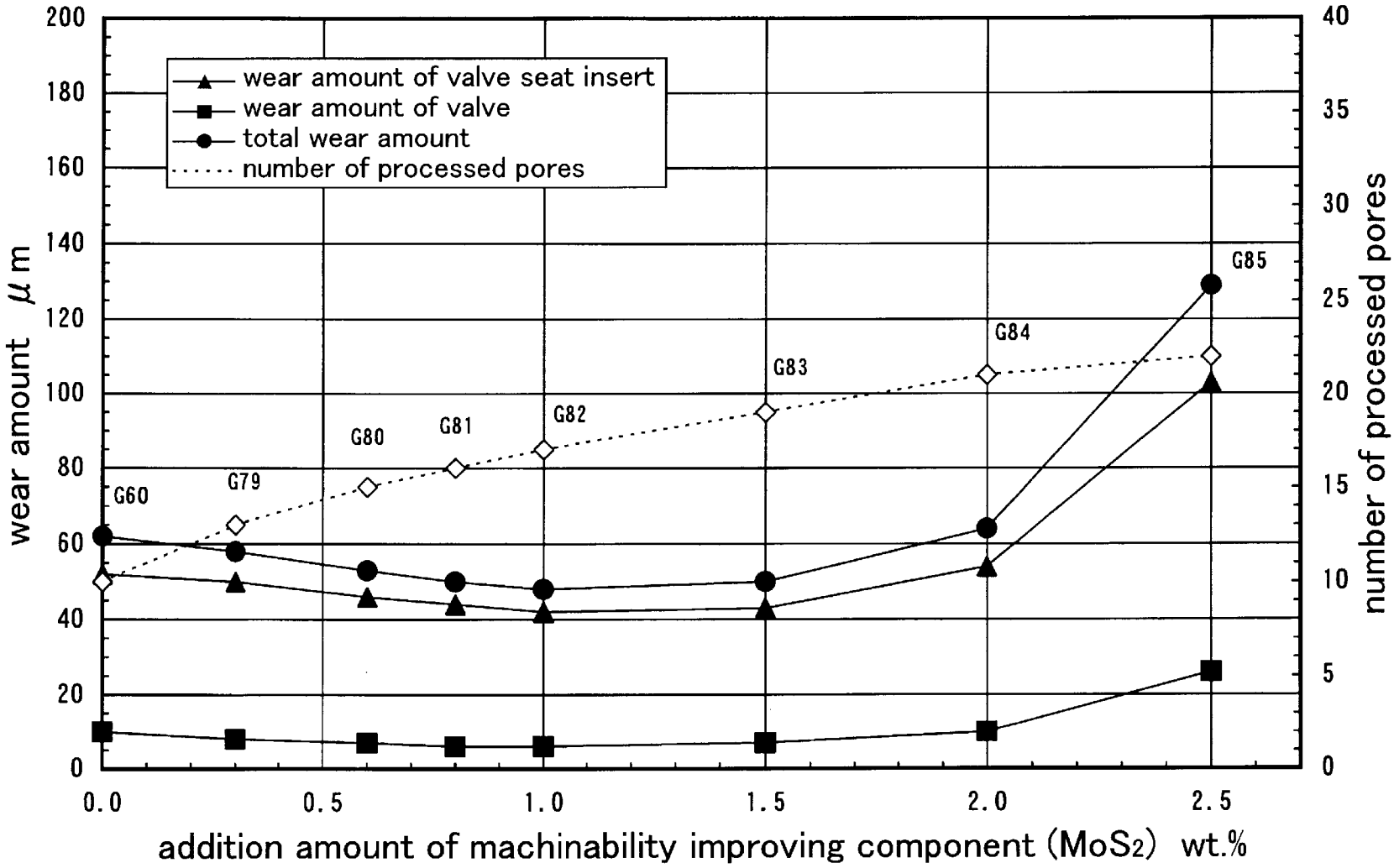
FIG. 18 is a graph showing the relationship between an addition amount of the machinability improving component and wear amount in the fifth Example according to the present invention.

FIG. 18 shows the effect of an addition amount of the machinability improving component ($MoS_2$ powder). In addition, for comparison therewith, the result of sample number G60 in which the machinability improving component was not used, was also plotted. As is clear from FIG. 18, in the sintered alloy sample containing the machinability improving component powder, the number of processed pores was more than in sample number G60 and increased as the addition amount of the machinability improving component powder increased, and therefore, the machinability was improved. However, in sample number G85 in which the addition amount of the machinability improving component powder exceeded 2.0% by mass, the sintering was inhibited, the strength of the sintered alloy lowered, and the wear thereby rapidly progressed.

Figure 19:
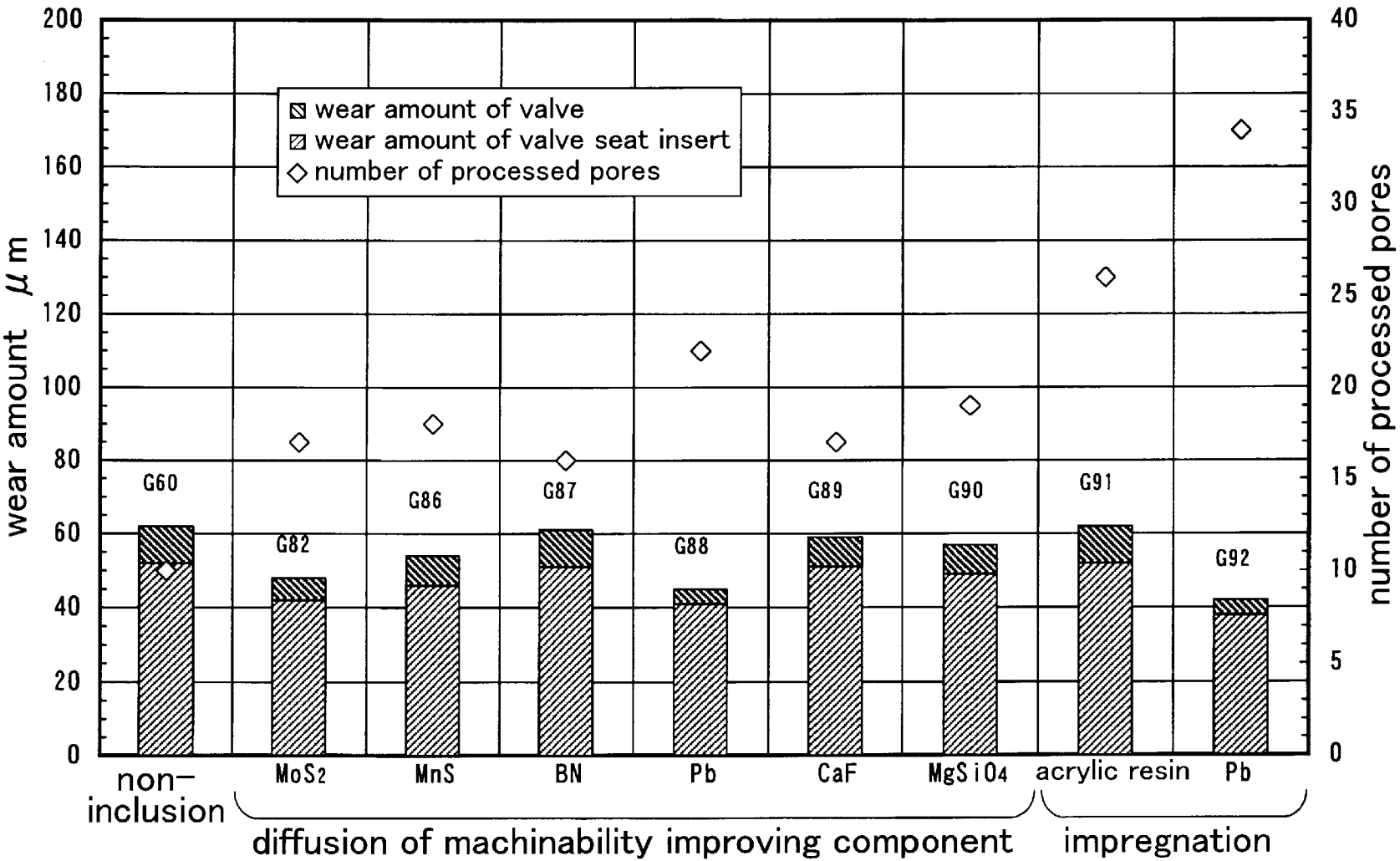
FIG. 19 is a graph showing the relationship between species of the machinability improving component and wear amount in the fifth Example according to the present invention.

FIG. 19 shows the effect of species of the machinability improving component when the machinability improving component powder was added in an amount of 1% by mass. As is clear from FIG. 19, also in the case in which MnS, BN, Pb, CaF, or $MgSiO_4$was used as a machinability improving component other than $MoS_2$, it was confirmed to have a similar machinability improving effect. In addition, it was confirmed that filling of acrylic resin or Pb in the pores was also effective as a machinability improvement technique.

What is claimed is:

1. A wear resistant sintered member exhibiting a metallographic structure comprising a first hard phase and a second hard phase diffused in an Fe-based alloy matrix, wherein the first hard phase comprises Mo silicide particles dispersed in an Fe-based alloy matrix of the first hard phase, the second hard phase comprises a ferrite phase or a mixed phase of ferrite and austenite having a higher Cr concentration than the Fe-based alloy matrix surrounding a core consisting of Cr carbide particles, the Mo silicide particles in the first hard phase are contained in an amount of 3 to 25% by area in the member, and the Cr carbide particles in the second hard phase are contained in an amount of 3 to 30% by area in the member.

2. A wear resistant sintered member having an overall composition comprising, by mass, Mo: 1.25 to 17.93%, Si: 0.025 to 3.0%, C: 0.35 to 0.95%, at least one of Cr: 0.025 to 3.0% and Ni: 0.025 to 3.0%, and a balance of Fe and unavoidable impurities, and exhibiting a metallographic structure comprising an alloy matrix which consists of bainite or a mixture of bainite and martensite, and a first hard phase comprising Mo silicide particles dispersed in an alloy matrix of the first hard phase which consists of Fe and at least one of Ni and Cr, wherein the Mo silicide particles in the alloy matrix of the first hard phase are contained in an amount of 3 to 30% by area in the member.

3. A wear resistant sintered member having an overall composition comprising, by mass, Mo: 1.01 to 15.43%, Si: 0.025 to 2.5%, C: 0.36 to 1.67%, Cr: 0.2 to 7.5%, and a balance of Fe and unavoidable impurities, and exhibiting a metallographic structure comprising an alloy matrix which consists of bainite or a mixture of bainite and martensite, a first hard phase and a second hard phase diffused in an alloy matrix of the first hard phase, wherein the first hard phase comprises Mo silicide particles dispersed in the alloy matrix, the second hard phase comprises a ferrite phase or a mixed phase of ferrite and austenite, having a higher Cr concentration than the alloy matrix, surrounding a core consisting of Cr carbide particles, the Mo silicide particles in the first hard phase are contained in an amount of 3 to 25% by area in the member, and the Cr carbide particles in the second hard phase are contained in an amount of 3 to 30% by area in the member.

4. A wear resistant sintered member according to claim 1, further comprising at least one of Ni: 0.025 to 2.5% by mass and Cr: 0.025 to 2.5% by mass, wherein the alloy matrix of the first hard phase consists of Fe and at least one of Ni and Cr, and the Mo silicide particles are dispersed in the alloy matrix of the first hard phase.

5. A wear resistant sintered member according to claim 2, further comprising at least one of Ni: 0.025 to 2.5% by mass and Cr: 0.025 to 2.5% by mass, wherein the alloy matrix of the first hard phase consists of Fe and at least one of Ni and Cr, and the Mo silicide particles are dispersed in the alloy matrix of the first hard phase.

6. A wear resistant sintered member according to claim 3, further comprising at least one of Ni: 0.025 to 2.5% by mass and Cr: 0.025 to 2.5% by mass, wherein the alloy matrix of the first hard phase consists of Fe and at least one of Ni and Cr, and the Mo silicide particles are dispersed in the alloy matrix of the first hard phase.

7. A wear resistant sintered member according to claim 1, further comprising, by mass, at least one of V: 0.01 to 0.66%, W: 0.05 to 1.5%, and Mo: 0.09 to 0.15%, wherein at least one of Mo carbide, V carbide, and W carbide is dispersed in the core of the second hard phase.

8. A wear resistant sintered member according to claim 3, further comprising, by mass, at least one of V: 0.01 to 0.66%, W: 0.05 to 1.5%, and Mo: 0.09 to 0.15%, wherein at least one of Mo carbide, V carbide, and W carbide is dispersed in the core of the second hard phase.

9. A wear resistant sintered member according to claim 1, further comprising by mass, at least one of Ni: 0.025 to 2.5% and Cr: 0.025 to 2.5%, and at least one of V: 0.01 to 0.66%, W: 0.05 to 1.5%, and Mo: 0.09 to 0.15%, wherein the alloy matrix of the first hard phase consists of Fe and at least one of Ni and Cr, at least one of Mo carbide, V carbide, and W carbide is dispersed in the core of the second hard phase, and the Mo silicide particles are dispersed in the alloy matrix of the first hard phase.

10. A wear resistant sintered member according to claim 3, further comprising by mass, at least one of Ni: 0.025 to 2.5% and Cr: 0.025 to 2.5%, and at least one of V: 0.01 to 0.66%, W: 0.05 to 1.5%, and Mo: 0.09 to 0.15%, wherein the alloy matrix of the first hard phase consists of Fe and at least one of Ni and Cr, at least one of Mo carbide, V carbide, and W carbide is dispersed in the core of the second hard phase, and the Mo silicide particles are dispersed in the alloy matrix of the first hard phase.

11. A wear resistant sintered member according to claim 1, wherein the alloy matrix further comprises of a machinability improving component of 0.3 to 2.0% by mass.

12. A wear resistant sintered member according to claim 2, wherein the alloy matrix further comprises of a machinability improving component of 0.3 to 2.0% by mass.

13. A wear resistant sintered member according to claim 3, wherein the alloy matrix further comprises of a machinability improving component of 0.3 to 2.0% by mass.

14. A wear resistant sintered member according to claim 11, wherein the machinability improving component is at least one of lead, manganese sulfide, molybdenum disulfide, boron nitride, calcium fluoride, and magnesium metasilicate mineral.

15. A wear resistant sintered member according to claim 12, wherein the machinability improving component is at least one of lead, manganese sulfide, molybdenum disulfide, boron nitride, calcium fluoride, and magnesium metasilicate mineral.

16. A wear resistant sintered member according to claim 13, wherein the machinability improving component is at least one of lead, manganese sulfide, molybdenum disulfide, boron nitride, calcium fluoride, and magnesium metasilicate mineral.

17. A wear resistant sintered member according to claim 1, wherein one of lead, lead alloy, copper, copper alloy, and acrylic resin, is filled in pores of the wear resistant sintered member.

18. A wear resistant sintered member according to claim 2, wherein one of lead, lead alloy, copper, copper alloy, and acrylic resin, is filled in pores of the wear resistant sintered member.

19. A wear resistant sintered member according to claim 3, wherein one of lead, lead alloy, copper, copper alloy, and acrylic resin, is filled in pores of the wear resistant sintered member.

* * * * *